US007749434B2

(12) United States Patent
Naslund et al.

(10) Patent No.: US 7,749,434 B2
(45) Date of Patent: Jul. 6, 2010

(54) DEVICE AND METHOD FOR STERILIZATION

(75) Inventors: Lars Ake Naslund, Furulund (SE); Goran Hermodsson, Staffanstorp (SE); Lars Martensson, Veberod (SE); Arun Deivasigamani, Minneapolis, MN (US); Paul Anderson, Woodbury, MN (US)

(73) Assignee: Tetra Laval Holdings & Finance S.A., Pully (CH)

( * ) Notice: Subject to any disclaimer, the term of this patent is extended or adjusted under 35 U.S.C. 154(b) by 1045 days.

(21) Appl. No.: 10/563,574

(22) PCT Filed: Jun. 22, 2004

(86) PCT No.: PCT/SE2004/000997

§ 371 (c)(1),
(2), (4) Date: Jan. 6, 2006

(87) PCT Pub. No.: WO2005/002973

PCT Pub. Date: Jan. 13, 2005

(65) Prior Publication Data

US 2006/0159583 A1 Jul. 20, 2006

(30) Foreign Application Priority Data

Jul. 8, 2003 (SE) ..... 0302024

(51) Int. Cl.

| | |
|---|---|
| ***A61L 2/00*** | (2006.01) |
| ***A61L 9/00*** | (2006.01) |
| ***B01J 19/08*** | (2006.01) |
| ***B08B 7/00*** | (2006.01) |
| ***B08B 9/00*** | (2006.01) |
| ***B08B 3/00*** | (2006.01) |
| ***G01N 21/00*** | (2006.01) |
| ***A61N 5/00*** | (2006.01) |
| ***G21F 5/02*** | (2006.01) |
| ***B65B 55/02*** | (2006.01) |
| ***A23C 3/07*** | (2006.01) |
| ***A21D 6/00*** | (2006.01) |

(52) U.S. Cl. ..... 422/1; 422/23; 422/24; 422/31; 422/32; 422/28; 422/186; 422/186.05; 422/186.3; 422/292; 422/294; 422/302; 422/304; 422/305; 134/1; 134/6; 134/22.1; 134/32; 134/48; 134/52; 250/453.11; 250/455.11; 250/492.2; 250/492.3; 250/496.1; 250/454; 53/425; 53/426; 53/300; 53/381.4; 53/282; 426/248; 426/399; 426/407; 426/413; 204/157.15; 204/158.2; 204/198; 141/114; 141/313; 141/372; 141/10; 141/89; 99/451

(58) Field of Classification Search ..... 422/1, 422/23–24, 31–32, 28, 186, 186.05, 186.3, 422/292, 294, 302, 304–305; 134/1, 6, 22.1, 134/32, 48, 52; 250/453.11, 455.11, 492.2, 250/492.3, 496.1, 454; 53/425–426, 300, 53/381.4, 282, 284.7, 167; 99/451; 141/114, 141/313, 372, 10, 89, 91–92; 204/157.15, 204/158.2, 198; 426/248, 399, 407, 413
See application file for complete search history.

(56) References Cited

U.S. PATENT DOCUMENTS

| | | | |
|---|---|---|---|
| 6,039,922 | A | 3/2000 | Swank et al. |
| 6,221,216 | B1 | 4/2001 | Nablo et al. |

FOREIGN PATENT DOCUMENTS

| | | |
|---|---|---|
| CH | 595 248 | 2/1978 |
| GB | 1 470 990 | 4/1977 |
| JP | 48-5585 | 1/1973 |
| JP | 61-203322 A | 9/1986 |
| JP | 11-114030 A | 4/1999 |
| JP | 2000-128131 A | 5/2000 |

OTHER PUBLICATIONS

*English translation of Official Action issued Nov. 28, 2008 in Japanese Patent Application No. 2006-518580.
*English translation of Decision of Rejection issued Oct. 29, 2009 in Japanese Patent Application No. 2006-518580.

*Primary Examiner*—Jill Warden
*Assistant Examiner*—Monzer R Chorbaji

(74) *Attorney, Agent, or Firm*—Buchanan Ingersoll & Rooney PC

(57) ABSTRACT

The invention refers to a device (1) and method for sterilizing partly formed packages (6) in a packaging machine. The device (1) comprises an inner chamber (2) and an outer chamber (3), the inner chamber (2) being provided with a sterilization unit (5). Further, it comprises a carrier unit (10), comprising a separating member (11) and a package carrying member (12), which is being adapted to rotate between a first position in which the package carrying member (12) is located in the outer chamber (3), and in which the separating member (11) separates the inner chamber (2) from the outer chamber (3), and a second position in which the carrier unit (10) has rotated a package (6) into the inner chamber (2) and in which the separating member (11) separates the inner chamber (2) from the outer chamber (3).

28 Claims, 9 Drawing Sheets

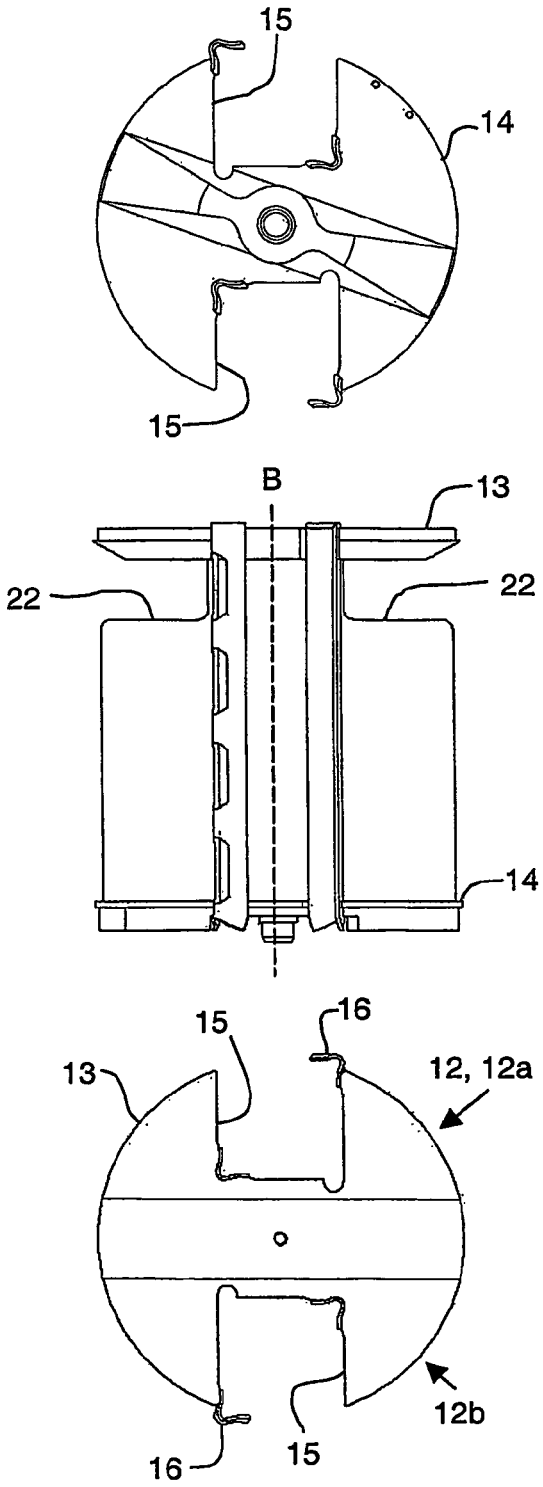
Fig. 5
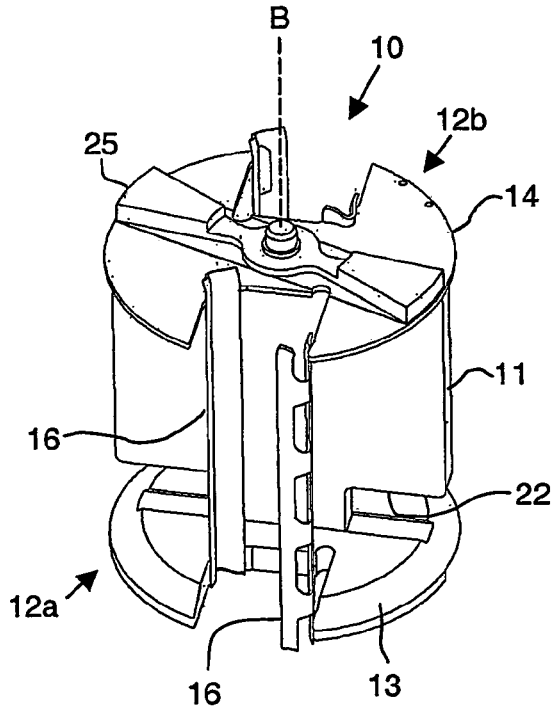

DEVICE AND METHOD FOR STERILIZATION

THE FIELD OF INVENTION

The present invention refers to a device and a method for sterilizing at least partly formed packages in a packaging machine.

TECHNICAL BACKGROUND

Within the food packaging industry it has for a long time been used packages formed from blanks of packaging material, the material being comprised of different layers of paper or board, liquid barriers of for example polymers and gas barriers of for example thin films of aluminium. The blanks are preformed from a material web, which is provided with a pattern of crease lines facilitating forming and folding of packages. The web is cut into pieces, each piece having a size and shape for making one package. After cutting, each piece is folded into a flat tube-formed blank having its longitudinal edges overlapping each other. Next, the longitudinal edges are sealed by any appropriate, conventional sealing technology such as for example heat sealing. The result is a flat tube-formed blank. Forming a blank from a web is well known per se and will not be described in further detail.

In the packaging machine the blank is raised to form a tube usually having a square or rectangular cross section depending on the type of package. Thereafter, one end of the tube can be transversally sealed forming a bottom (or top) of the package and the package is ready to be filled with a product, for example food products like for instance beverages.

Partly formed packages that are open in one end and sealed to form a bottom or top in the other is commonly denoted Ready-To-Fill packages (RTF packages).

To extend the shelf-life of the products being packed it is prior known to sterilize the RTF packages before the filling operation. Depending on how long shelf-life is desired and whether the distribution and storage is made in chilled or ambient temperature, different levels of sterilization can be chosen. One way of sterilizing is to irradiate the inside of the package by electrons emitted from an electron beam emitter. However, irradiation with electrons creates unwanted X-rays. The electrons are first slowed down when passing the electron beam exit window (which will be explained later) and then further slowed down as they collide with amongst others air molecules, bacteria, the package and the walls of the shielding. This decrease of the speed of the electrons gives rise to the emission of X-rays. When such an X-ray hits the shielding, the X-ray enters a certain distance into the material and causes emittance of new X-rays.

So far it has been a problem to obtain acceptable radiation levels outside an irradiation device of reasonable size where RTF packages can pass into and out from in short time.

When using a sterilizing unit such as an electron beam emitter there are also two other issues that usually should be considered. The first consideration is how to safely discharge ozone from the device thereby minimising the risk of ozone leakage to the outside of the device. It is common knowledge that the presence of oxygen molecules ($O_2$) in an electron irradiation device give rise to the formation of ozone during electron irradiation because of radical reactions. Somewhat similar problems arise with sterilization using ultraviolet radiation or chemical sterilization using for instance hydrogen peroxide in gas phase. During use of ultraviolet radiation it is desired to prevent the rays of light from being reflected directly to the outside of the device and when using hydrogen peroxide one wants to isolate the hydrogen peroxide in the sterilizing device and also prevent ozone ($O_3$), created during sterilizing, to leak out of the unit.

The second consideration is how to maintain a desired sterilization level inside the sterilizing device. A device for sterilization of at least partly formed packages is formed with openings for the entrance and exit of packages. Unfortunately, bacteria and other spoilage organisms may enter through the openings and also through interconnections between different portions of the device and the surrounding equipment. If these bacteria and spoilage organisms are left in the device they may recontaminate the packages after they have been sterilized. Moreover, the packages are transported on a conveyor through the machine and the unsterilized packages are removed from the conveyor for sterilization. Afterwards, they are returned to the same conveyor and placed beside still unsterilized packages. Thus, there is also a risk of recontamination of sterilized packages outside the device. It should however be noted that this consideration does not always need to be taken into account. The required level of sterilisation for obtaining a satisfactory shelf-life is different for different types of products and is also, as previously mentioned, depending on whether the distribution and storage is made in chilled or ambient temperature. It has been found that for some products that are not that sensitive, for example juices, and products which are distributed in chilled environment, a satisfactory level of sterilisation, and thereby an acceptable shelf-life, can still be obtained.

SUMMARY OF THE INVENTION

Therefore, an object of the invention has been to provide a device for electron beam irradiation where the radiation level outside the device is acceptable.

The invention comprises a device for sterilizing at least partly formed packages in a packaging machine, said device comprises an inner chamber and an outer chamber, the inner chamber being provided with a sterilization unit for sterilizing at least the inside of at least one partly formed package, the device further comprises a carrier unit comprising at least one separating member and at least one package carrying member, the carrier unit being adapted to rotate between a first position in which said at least one package carrying member is located in the outer chamber and adapted to return and receive at least one package, and in which said at least one separating member separates the inner chamber from the outer chamber, and a second position in which the carrier unit has rotated and displaced said at least one package into the inner chamber and in which said at least one separating member separates the inner chamber from the outer chamber, and the device further comprises means for providing a relative motion between the package and the sterilizing unit for bringing them to a position in which the sterilizing unit is located at least partly in the package for treating it.

Thus, the invention comprises a shielding formed so that it is possible to pass partly formed packages between the outside of the shielding and a space inside the shielding, and still minimise the risk of X-rays being able to find their way out of the shielding, without first having their energy reduced to an acceptable limiting value. The limiting value can for example be settled by governmental regulations or market acceptance.

The first position is defined as a position outside the shielding and the second position is defined as a position inside the shielding.

To use rotation, compared to for example linear motion, provides for a simpler displacement of heavy components and a rotation drive unit does not take up more space in its first position than in its second position.

Further, the easiest way to separate two chambers from each other is by a separating member and the easiest way of being able to displace a package from one chamber to the other is to rotate the separating member. It should however be noted that the word separation has a different meaning for different sterilization methods. When using electron beam sterilization the separation is a radiation shielding, and when using ultraviolet radiation the separation should prevent rays of light from being reflected from one chamber to the other.

The above-described design can also easily be adapted to maintain a desired sterilization level inside the sterilizing device and safely discharge ozone from the device thereby minimising the risk of ozone leakage to the outside of the device.

Furthermore, it will be shown that this design is advantageous in that it can be used to accumulate the time needed for treatment of a package. A sterilizing unit of reasonable size and effect needs a certain time to sterilize the package. However, the time needed is usually longer than what is available with regard to the cycle time of a high speed packaging machine, that is, most often the cycle time in such a machine is too short for it being possible to, within that time, lift the package inside a shielding, sterilize it and bring it back to the conveyor. Here the sterilizing unit can for example treat the package at least throughout a package indexing step. Thus, the design provides for accumulation of treatment time.

In a preferred embodiment of the invention the inner and outer chambers form a housing, and the carrier unit is rotatably connected to said housing. By providing a housing enclosing the chambers, and thereby the emitter, it is easier to encapsulate primary X-rays. Moreover, this makes it easier to encapsulate, control and discharge ozone formed during irradiation.

In a further preferred embodiment the relative motion between the package and the sterilizing unit involves the package moving towards the sterilizing unit to surround it. Since a sterilizing unit, like an electron beam emitter, is most often both sensitive to vibrations, relatively heavy and coupled to for example a power supply etc. it is preferred not to move it, but to move the packages (which are being more easy to move and less sensitive). In this way the working life of the sterilizing unit can also be increased.

In another preferred embodiment the outer chamber is provided with a package opening for entrance and exit of packages to and from the device. In this way the device can be placed separated from the package conveyor of the machine and the packages are removed from the conveyor for treatment.

In yet another embodiment the separating member is substantially shaped as a plate, and the carrying member comprises two substantially disc-shaped members, both being perpendicularly arranged in relation to the separating member. In this way a simple, uniform and robust design is obtained which is suitable for rotating. Further, the plate and the discs being a part of the shielding. In the first and second position of the carrier unit, the plate, separating the inner and outer chamber from each other, will force a substantial part of the X-rays hit either at least the inner chamber wall or the plate before leaving the inner chamber. Thus, the desired reduction of the energy of the X-rays are obtained. During rotation between the first and the second position the plate is not separating the two chambers. Instead the discs, being perpendicular to the plate, act as shields forcing a substantial part of the X-rays hit either the inner chamber wall or the discs before leaving the inner chamber. Thus, also during rotation the desired reduction of the energy of the X-rays are obtained.

Advantageously, the disc-shaped members each being non-rotatably connected to a respective end portion of the separating member. In this way the carrier unit is being adapted to bring at least one package with itself during the rotation, thereby easily displacing the package.

In an additional embodiment the two disc-shaped members are provided with at least one throughgoing opening each, the openings being aligned with each other. In this way the packages only need to be displaced in one direction within the carrier unit, which provides for a simple design.

Preferably, the carrying member is provided with holding means being aligned with the openings. In this way the packages can easily be held during the rotation of the carrier unit and easily be displaced when desired.

Advantageously, the inner chamber comprises a first and a second chamber portion. Thus, the first chamber portion can more easily be adapted to the sterilizing unit and the second chamber portion to the carrier unit with regard to size and shape.

In a preferred embodiment the sterilizing unit is located in said first chamber portion, and wherein the carrying member, in the second position, is located in said second chamber portion so that the openings in the carrying member are adapted to be aligned with the sterilizing unit, so that the package can be displaced to the position in which the sterilizing unit is located at least partly in the package for treating it. As mentioned before the packages only need to be displaced in one direction which provides for a simple design. Also the emitter can be placed above the portion of the carrier unit being located inside the inner chamber.

Advantageously, the carrying member, in the first position, is adapted to be positioned so that the openings are aligned with the package opening in the housing, so that the package can enter and exit the device. As mentioned before there is an advantage that the packages only need to be displaced in one direction.

Further, the device is adapted to raise the package through the package opening in the housing and into the carrying member when the carrying member is in the first position, rotate the carrying member to the second position, raise the package to a position in which it at least partly surrounds the sterilizing unit, sterilize the package with the sterilizing unit, lower it back to the carrying member, rotate the carrying member back to the first position, and lower the package out of the carrying member and out of the package opening in the housing. By providing this displacement of the package, the emitter can be positioned relatively far away from the opening in the housing, thereby increasing the number of hits that the X-rays are subject to. Each hit give a considerable decrease of the energy of the X-rays.

Preferably, the device comprises first displacing means adapted to raise the package from the carrying member to a position in which the package at least partly surrounds the sterilizing unit and adapted to lower the package back to the carrying member.

Advantageously, the device comprises second displacing means adapted to raise the package through the package opening and into the carrying member and adapted to lower the package out of the carrying member and out of the package opening in the housing.

In a preferred embodiment the carrier unit comprises at least a first and a second carrying member, at least one at either side of the separating member, so that the first carrying member is adapted to rotate a first package from the first position to the second position at the same time as the second carrying member is adapted to rotate a second package from the second position to the first position. In this way the sterilizing can be carried out more effectively in that more packages are sterilized per time unit.

In another embodiment the device is adapted to raise a first package through the package opening in the housing and into the first carrying member, the first carrying member being in the first position, and at the same time lower a second package from a position in which it at least partly surrounds the sterilizing unit down to the second carrying member, the second carrying member being in the second position. This also results in that the sterilizing can be carried out more effectively as more packages are sterilized per time unit.

In yet another embodiment the device is adapted to lower a first package from the first carrying member out through the package opening in the housing, the first carrying member being in the first position, and at the same time raise a second package from the second carrying member, the second carrying member being in the second position, to a position in which the second partly formed package at least partly surrounds the sterilizing unit. As already mentioned above, the sterilizing can be carried out more effectively if two packages are handled in the device at the same time.

In a preferred embodiment the sterilizing unit is an electron beam emitter. One advantage with using electron beam emitters is that packages can be effectively sterilized. Alternatively, the sterilization unit comprises a UV-lamp for sterilization using ultraviolet radiation or the sterilization unit comprises a means for chemical sterilization, for example using hydrogen peroxide. Another advantage with using electron beam emitters is that the sterilization of packages can commence as soon as the emitter is turned on, i.e. as soon as the emitter is in operation, whereas a device for chemical sterilization often need some time warming up after being started.

Preferably, the sterilizing unit comprises more than one low voltage electron beam emitter. In this way the amount of packages being sterilized per time unit can be increased.

Advantageously, the carrying member is adapted to carry more than one package. This is also one way of increasing the sterilization capacity per time unit.

In a preferred embodiment the inner chamber is being provided with a gaseous fluid supply, the outer chamber being in connection with an outer housing via a package opening, the outer housing at least partly surrounding a package conveyor and being provided with a gaseous fluid outlet, said outlet being located in a portion of the outer housing that is being arranged from the package opening in a direction opposite the direction of travel of the package conveyor, the supply and the gaseous fluid outlet are adapted to create a flow of a gaseous fluid from the inner chamber, through the carrier unit, through the outer chamber, through the package opening in the housing to the outer housing, and through at least a portion of the outer housing in a direction towards the gaseous fluid outlet. By providing a flow of gaseous fluid through the device and the outer housing in a direction opposite the direction of travel of the conveyor the level to which the package has been sterilized can be maintained, the level being suitable for example for sensitive products, products for which a long shelf-life is required or products that are to be distributed or stored in ambient temperature. Any bacteria or other spoilage organisms entering the outer housing at any point will be transported by the flow to that end where the unsterilised packages enters the outer housing, and there it will be discharged through the gaseous fluid outlet. The risk of recontamination of the sterilised packages before filling and sealing operations is thereby minimised. Further, ozone ($O_3$) that is formed during irradiation with electrons can be effectively and reliably discharged from the chambers by the same flow of gaseous fluid. The risk of leakage of ozone to the outside of the device and the outer housing is thereby minimised.

An additional advantage is that the flow of gaseous fluid is suitable for use during pre-sterilization of the device. Hydrogen peroxide can for example be supplied to the gaseous fluid and thereby the surfaces of both chambers are sterilised.

In another preferred embodiment the inner chamber is being provided with a gaseous fluid outlet, the outer chamber being in connection with an outer housing via a package opening, the outer housing at least partly surrounding a package conveyor and being provided with gaseous fluid supplies, at least one of which is being located in a portion of the outer housing that is being arranged from the package opening in a direction being the direction of travel of the package conveyor, and at least one of which being located in a portion of the outer housing that is being arranged from the package opening in a direction opposite the direction of travel of the package conveyor, the outlet and the gaseous fluid supplies are adapted to create a flow of a gaseous fluid towards the package opening in the housing, through the opening and into the outer chamber, through the carrier unit, and through the inner chamber to the gaseous fluid outlet. By providing a such flow of gaseous fluid through the device the level to which the package has been sterilized can be maintained, the level being suitable for products not being that sensitive, for example juices, and products which are to be distributed in chilled environment. Further, as previously mentioned, ozone that is formed during irradiation with electrons can be effectively and reliably discharged from the chambers by the same flow of gaseous fluid. The risk of leakage of ozone to the outside of the device and the outer housing is thereby minimised.

The invention also relates to a method for sterilizing at least partly formed packages in a packaging machine. The method comprises the steps of: providing an inner chamber and an outer chamber, arranging a sterilizing unit in the inner chamber for sterilizing at least the inside of at least one package, providing a carrier unit comprising at least one separating member and at least one package carrying member, providing rotation of the carrier unit between a first position in which said at least one package carrying member is located in the outer chamber and in which said at least one separating member separates the inner chamber from the outer chamber, and a second position in which the package carrying member is located in the inner chamber and in which the separating member separates the inner chamber from the outer chamber, and providing a relative movement between the package and the sterilizing unit for bringing them to a position in which the sterilizing unit is located at least partly in the package for treating it. As explained before the method provides a way of shielding so that it is possible to pass partly formed packages between the outside of the shielding and a space inside the shielding, and still minimise the risk of X-rays being able to find their way out of the shielding, without first having their energy reduced to an acceptable limiting value. As mentioned before rotation, compared to for example linear motion, provides for a simpler displacement of heavy components and a rotation drive unit does not take up more space in its first position than in its second position.

Further, as been mentioned before, the easiest way to separate two chambers from each other is by a separating member and the easiest way of being able to displace a package from one chamber to the other is to rotate the separating member. It should however be noted that the word separation has a different meaning for different sterilization methods. When using electron beam sterilization the separation is a radiation shielding, and when using ultraviolet radiation the separation should prevent rays of light from being reflected from one chamber to the other.

In a preferred embodiment of the method it comprises the steps of: raising the package through the package opening in the housing and into the carrying member when the carrying member is in the first position, rotating the carrying member to the second position, raising the package to a position in which it at least partly surrounds the sterilizing unit, sterilizing the package with the sterilizing unit, lowering it back to the carrying member, rotating the carrying member back to the first position, and lowering the package out of the carrying member and out of the package opening in the housing. This results in a simple and fast displacement of the packages. The portions of the total displacement are simple, which makes it possible to use simple displacing means. Further, the emitter can be placed at a distance from the conveyor which facilitates the shielding and makes it possible to use conventional conveyors.

Advantageously, the method comprises the steps of: raising at least one first package through the package opening in the housing and into the first carrying member, the first carrying member being in the first position, and at the same time lowering a sterilized second package from a position in which it at least partly surrounds the sterilizing unit down to the second carrying member, the second carrying member being in the second position, rotating the carrier unit so that the first carrying member with the first package is rotated from the first position to the second position at the same time as rotating the second carrying member with the second package from the second position to the first position, lowering the sterilized second package from the second carrying member out through the package opening in the housing, and at the same time raising the first package from the first carrying member, being located inside the inner chamber, to a position in which the first package at least partly surrounds the sterilizing unit, and sterilizing the first package. In this way the time needed for treatment of a package can be accumulated. As previously mentioned a sterilizing unit of reasonable size and effect needs a certain time to sterilize the package. However, the time needed is usually longer than what is available with regard to the cycle time of a high speed packaging machine, that is, most often the cycle time in such a machine is too short for it being possible to, within that time, lift the package inside a shielding, sterilize it and bring it back to the conveyor. Here the sterilizing unit can for example treat the package at least throughout a package indexing step. Thus, the design provides for accumulation of treatment time.

Preferably, the sterilizing unit is an electron beam emitter. As mentioned earlier one advantage with using electron beam emitters is that packages can be effectively sterilized and that the sterilization of packages can commence as soon as the emitter is turned on.

In a preferred embodiment the method comprises the steps of: providing the inner chamber with a gaseous fluid supply, providing the outer chamber in connection with an outer housing via a package opening, the outer housing at least partly surrounding a package conveyor and being provided with a gaseous fluid outlet, said outlet being located in the portion of the outer housing that is being arranged from the package opening in a direction opposite the direction of travel of the package conveyor, creating a flow of the gaseous fluid from the inner chamber, through the outer chamber, through the package opening in the housing to the outer housing, and through at least a portion of the outer housing in a direction towards the gaseous fluid outlet. As being mentioned before, by providing a flow of gaseous fluid through the device and the outer housing in a direction opposite the direction of travel of the conveyor the level to which the package has been sterilized can be maintained, the level being suitable for example for sensitive products, products for which a long shelf-life is required or products that are to be distributed or stored in ambient temperature. Further, ozone that is formed during irradiation with electrons can be effectively and reliably discharged from the chambers by the same flow of gaseous fluid. The risk of leakage of ozone to the outside of the device and the outer housing is thereby minimised.

In another preferred embodiment the method comprises the steps of: providing the inner chamber with a gaseous fluid outlet, providing the outer chamber in connection with an outer housing via a package opening, the outer housing at least partly surrounding a package conveyor and being provided with gaseous fluid supplies, at least one of which is being located in a portion of the outer housing that is being arranged from the package opening in a direction being the direction of travel of the package conveyor, and at least one of which being located in a portion of the outer housing that is being arranged from the package opening in a direction opposite the direction of travel of the package conveyor, creating a flow of the gaseous fluid towards the package opening in the housing, through the opening and into the outer chamber, through the carrier unit, and through the inner chamber to the gaseous fluid outlet. By providing such a flow of gaseous fluid through the device a satisfactory level of sterilization can be maintained for products not being that sensitive, for example juices, and products which are to be distributed in chilled environment. Further, as previously mentioned, ozone that is formed during irradiation with electrons can be effectively and reliably discharged from the chambers by the same flow of gaseous fluid. The risk of leakage of ozone to the outside of the device and the outer housing is thereby minimised.

BRIEF DESCRIPTION OF THE DRAWINGS

In the following, a presently preferred embodiment of the invention will be described in greater detail, with reference to the enclosed drawings, in which.

Figure 3:
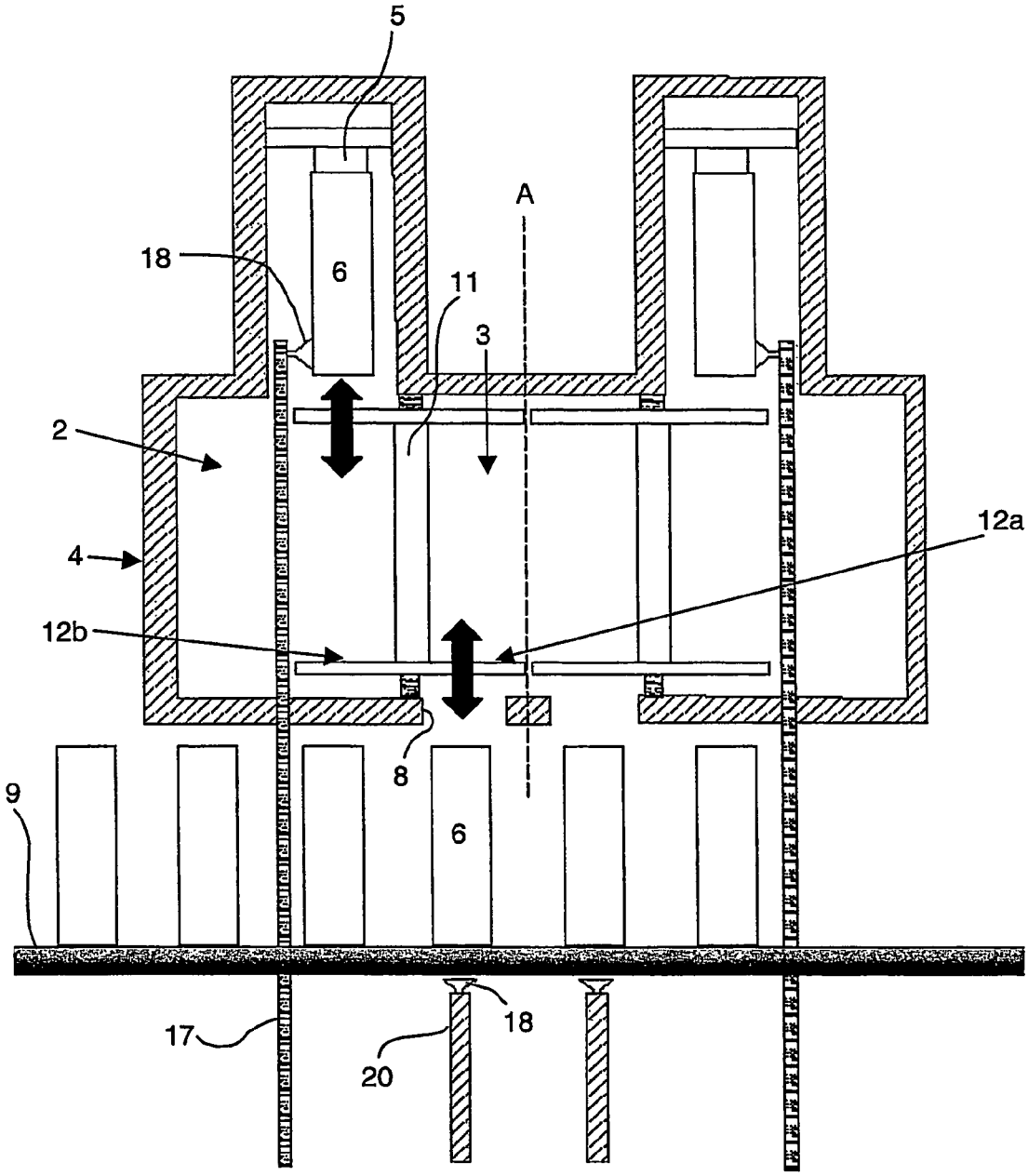
FIG. 3 shows a very schematic front view in cross section showing the displacement of the packages.
Figure 4:
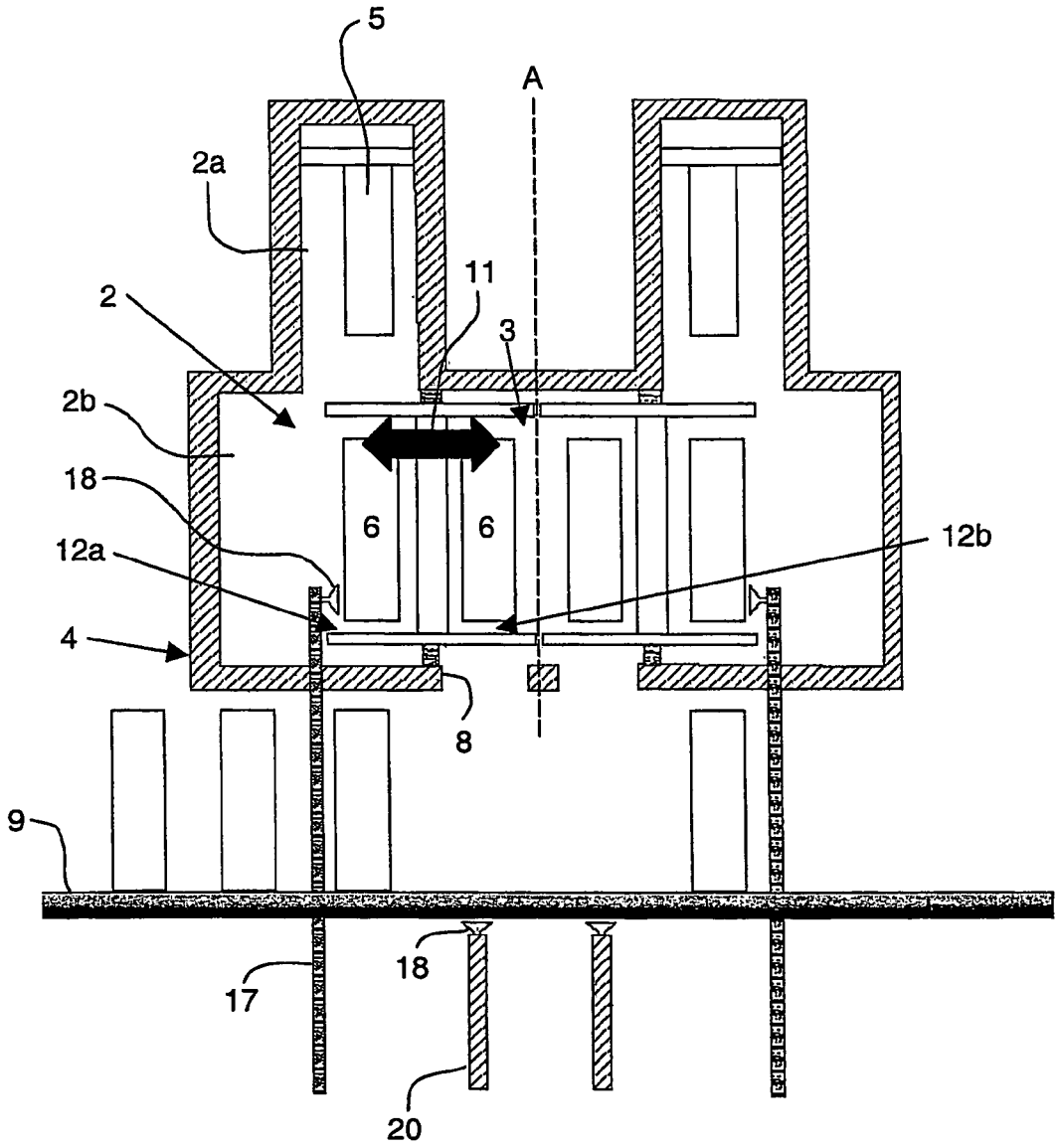
FIG. 4 shows a very schematic front view according to FIG. 3, but showing the rotation of the packages, FIG. 5 schematically shows different views of the carrier unit, FIG. 6 schematically shows a view of a first embodiment of the air system of the sterilizing device, FIG. 7 schematically shows a view of a second embodiment of the air system of the sterilizing device, and FIG. 8 schematically shows a part of the device from the side to display the presence of shielding plates in the outer housing.

It should be noted that FIGS. 3 and 4 are very simplified and their sole purpose is to show package displacement.

DESCRIPTION OF A PREFERRED EMBODIMENT

Figure 1A:
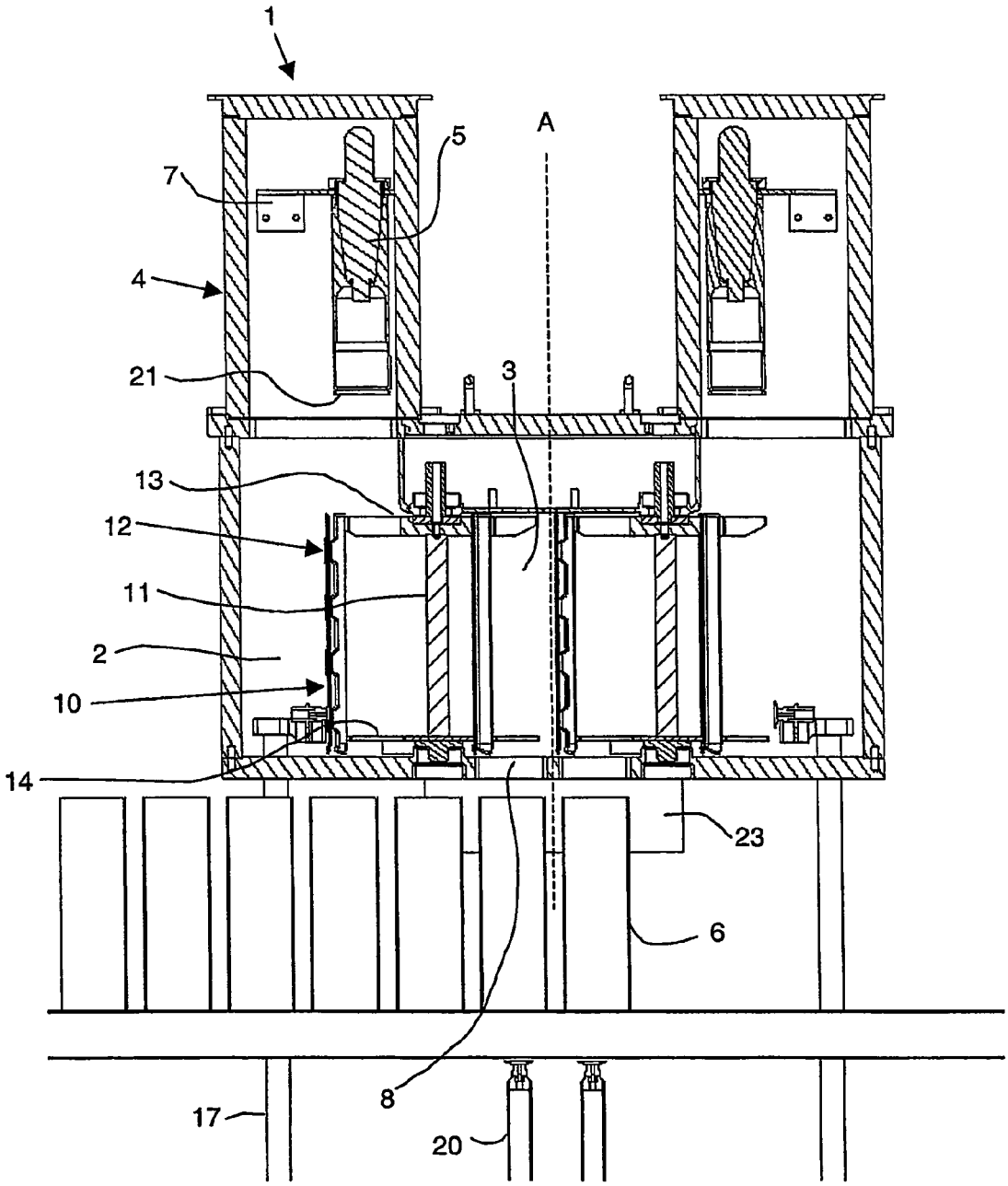
FIG. 1*a* schematically shows a front view in cross section of the sterilizing device in a position A in which the carrier unit separates the inner and outer chambers according to a preferred embodiment of the invention, FIG. 1*b* schematically shows position A, but in a cross section view from above, FIG. 2*a* schematically shows a view according to FIG. 1*a*, but in which the carrier unit is positioned a position B in which it does not separate the inner and outer chambers, FIG. 2*b* schematically shows a view according to FIG. 1*b*, but in which the carrier unit is positioned in position B.
Figure 2B:
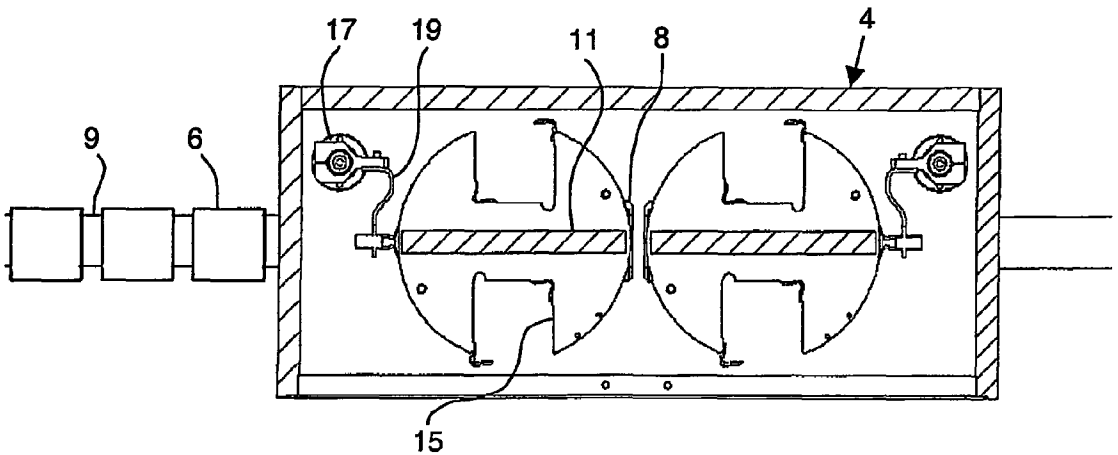
Figure 2A:
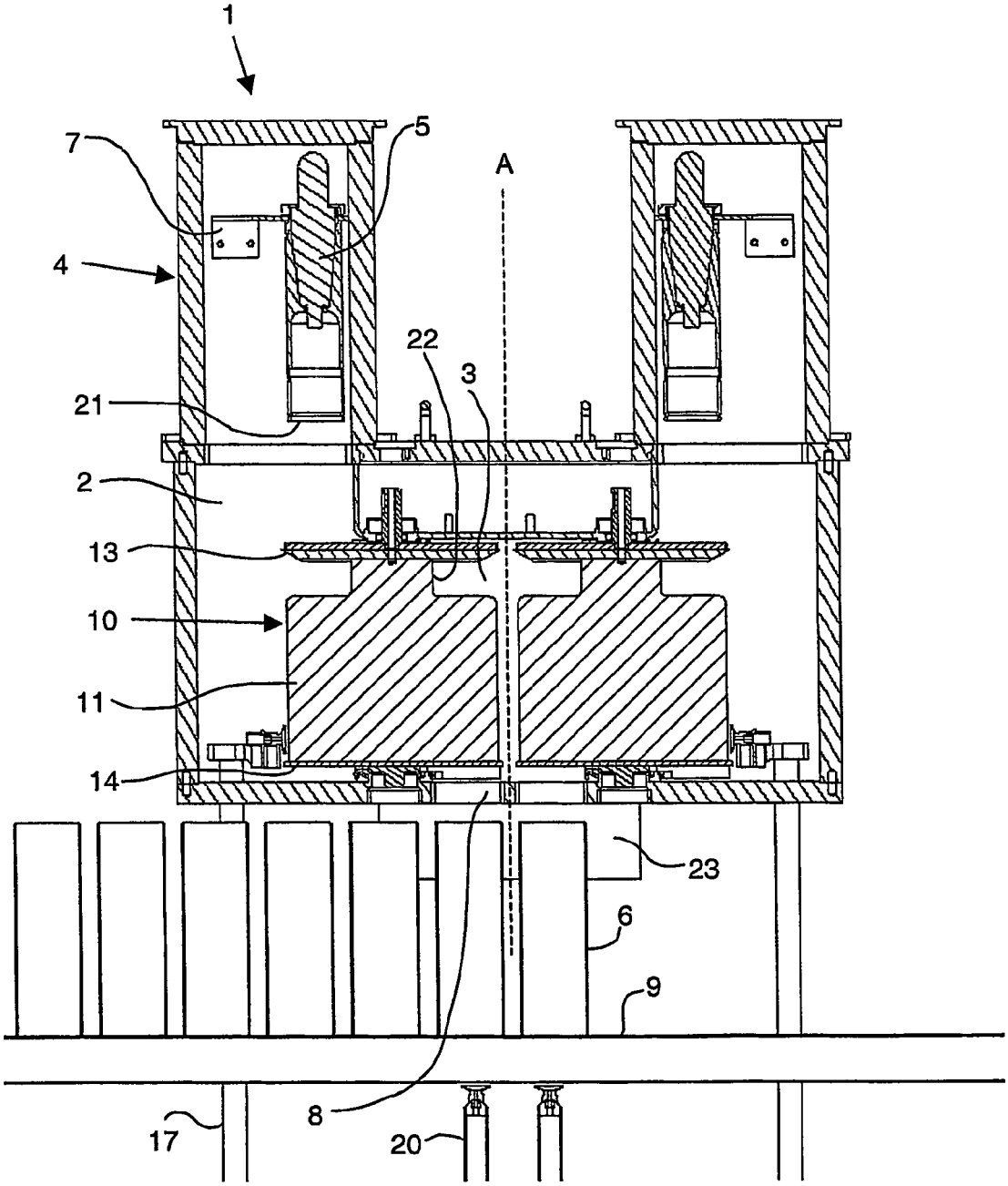

The device, as a whole denoted with the reference numeral 1 and shown in for example FIGS. 1*a* and 2*a*, comprises an inner chamber 2 and an outer chamber 3 connected to each other. Said chambers form a housing 4.

In the inner chamber 2 at least one sterilizing unit 5 is mounted. The sterilizing unit 5 is a low voltage electron beam emitter 5, which will be described in more detail later.

In the device 1 shown two emitters 5 are mounted after each other in relation to the package conveying direction through the packaging machine, meaning that two subsequent, adjacent, partly formed packages 6 can be sterilized simultaneously in the housing 4, one at each emitter 5.

Although two emitters 5 are shown, the device 1 will be described according to one emitter 5 only. It should however be understood that a device 1 comprising two emitters 5, as shown in for example FIG. 1*a*, can be obtained by mirroring the left side of the device 1 about an axis denoted A. Thus, the housing 4 comprises two inner chambers 2, one for each emitter 5, and two outer chambers 3, which are integrated into each other forming one common outer chamber.

The inner chamber 2 is provided with means 7 adapted to fasten the emitter 5 to the housing 4. This fastening means 7 is provided in a top inner wall of the inner chamber 2. The outer chamber 3 is provided with a throughgoing package opening 8 for the entrance and the exit of packages 6 to and from the housing 4, the opening 8 thus serving as both package inlet and package outlet. In the presently preferred embodiment the sterilizing device 1, and thus the housing 4, is arranged a distance above a package conveyor 9, which will be described later, and to provide transfer of packages 6 from the conveyor 9 and into the housing 4 and vice versa, the package opening 8 is located in the bottom of the housing 4, i.e. in wall of the housing 4 facing the conveyor 9. To minimise the opening 8 in the housing 4 the shape of the opening 8 substantially corresponds to the cross section of the package 6, and for a package with a uniform cross-section that is usually the shape of the bottom. Thus, in the case of handling for example uniform packages with square bottoms, the opening 8 has a similar square design, although preferably slightly larger to make the packages 6 pass through the opening 8 easier.

In FIG. 1*a* it is shown that in the mirrored housing 4 used for sterilizing two packages 6 at the same time, the mirroring is made in such a way that the distance between the two package openings 8 is similar to the distance between two adjacent packages 6 on the conveyor 9.

The conveyor 9 through the sterilizing section of the packaging machine can have different designs, and in this particular embodiment the conveyor 9, which is of a commercially available type, comprises a rail and a belt having prior known carrier means (not shown) for guiding and supporting the partly formed packages 6. The carrier means and the belt are designed so that there is a through-going opening underneath each package 6. As conveyors in packaging machines are well known in the prior art, the conveyor 9 will not be further described.

Furthermore, the device 1 comprises at least one carrier unit 10, which comprises at least one separating member 11 and at least one package carrying member 12. The carrier unit 10 is rotatably connected to the housing 4 and adapted to rotate between a first position in which said at least one package carrying member 12 is located in the outer chamber 3 and adapted to return and receive at least one package 6, and in which said at least one separating member 11 separates the inner chamber 2 from the outer chamber 3, and a second position in which the carrier unit 10 has rotated and displaced said at least one package 6 into the inner chamber 2 and in which said at least one separating member 11 separates the inner chamber 2 from the outer chamber 3.

The separating member 11 is aligned with a longitudinal centre axis B of the carrier unit 10, which centre axis B is also the axis of rotation of the unit. In the embodiment described the separating member 11 is substantially shaped as a plate, and in the following said plate will be referred to as the centre plate 11.

The package carrying member 12 comprises two substantially disc-shaped members, a first, top disc and a second, bottom disc. The discs are both being perpendicularly arranged in relation to the centre plate 11 and each being non-rotatably connected to a respective end portion thereof. Further, the discs are arranged at the end portions of the centre plate 11 in such a way that they extend from one of the sides of the centre plate 11.

The carrier unit 10 can comprise more than one package carrying member 12 and the carrier unit 10, shown in FIG. 5, comprises a first and a second carrying member 12*a*, 12*b* located at either side of the separating member 11. In FIG. 4 it is shown that the first carrying member 12*a* is adapted to rotate a first package 6 from the first position to the second position at the same time as the second carrying member 12*b* is adapted to rotate a second package 6 from the second position to the first position.

The carrier unit 10 is substantially uniform at both sides of the separating member 11, i.e. the two carrying members 12*a*, 12*b* are equal in shape. Thus, the pair of first, top discs of the carrying members are integrated into one common first, circular, top disc 13 and the pair of second discs of the carrying members are integrated into one common second, circular, bottom disc 14.

The first, top disc 13 and the centre plate 11 are affixed to each other by a slot in the top disc 13 cooperating with a corresponding protrusion of the centre plate 11.

The top disc 13 has a material thickness of about 22 mm and is made of stainless steel. The bottom disc 14 is also made of stainless steel, but can have a less thick material thickness. Like the top disc 13, the centre plate 11 has a material thickness of about 22 mm and is made of stainless steel.

The top and bottom discs 13, 14 are substantially circular with a diameter large enough to incorporate at least the size of one package 6 on either side of the centre plate 11.

The centre plate 11 is substantially square with a side length substantially corresponding to the diameter of the other two discs 13, 14.

As mentioned above, the carrier unit 10 is adapted to rotate and is therefore provided with at least one end shaft (not shown) being in connection with a servomotor (not shown). The end shaft is journalled in bearings (not shown) in the housing 4.

The two discs 13, 14 forming the package carrying members 12*a*, 12*b* are provided with at least one throughgoing opening 15 each and the openings 15 are aligned with each other.

In the embodiment shown in FIG. 5 the top and bottom discs 13, 14 are provided with two throughgoing openings 15 each adapted for passing packages 6 therethrough. One opening 15 is situated on either side of the centre plate 11 and they are located radially opposite each other, i.e. angled 180° from each other. Further, the pair of openings 15 in the top disc 13 is aligned with the pair of openings 15 in the bottom disc 14.

To minimise the risk of X-rays being able to escape through the sterilizing device 1 without having to hit a wall twice, the openings 15 in the carrier unit 10 should be as small as possible, i.e. have a size and shape substantially corresponding to the outer shape of the package 6. However, to facilitate the passage of the packages 6 through the openings 15, the size is made slightly larger than the package shape. In the embodiment the package 6 has a square form and therefore the openings 15 shown have a square shape. Further, the openings 15 in the bottom disc 14 can have a form and size corresponding to the package opening 8 in the housing 4.

Each carrying member 12*a*, 12*b* is provided with holding means 16 being aligned with the openings 15. The holding means 16 are in the form of rails for holding the packages 6 during the rotation of the carrier unit 10 and also for helping to guide the packages 6 during the displacement into or out from the carrier unit 10. The holding rails 16 extend between the discs 13, 14 and through the respective openings 15 in the discs 13, 14. Preferably, they even extend a short distance outside both the top and bottom discs 13, 14. As the RTF package 6 is made from a flattened tube-formed blank the open end thereof tends to spring back to its flattened tube-formed position, i.e. although the RTF package 6 obtains a square cross section in one of its ends during the bottom forming, the other still open end has a strong intrinsic biased behaviour that strives back to the flattened position thereby creating an end having a shape of a parallelogram. By providing support to the corners of the RTF-package 6 that want to strive outwards to form the parallelogram, the springback effect is used to effectively hold the package 6. Said holding rails 16 are therefore placed in two diagonally opposing corners of the openings 15, meaning that two rails 16 are running in parallel from two diagonally opposing corners in the opening 15 in the bottom disc 14 to corresponding corners in the opening 15 in the top disc 13.

The rails 16 are made of bars which in the longitudinal direction have a cross section that is angled, substantially right-angled.

With respect to the outer chamber 3, the carrier unit 10 is arranged in relation to the housing 14 so that its centre of rotation is arranged near the package opening 8 in the bottom of the housing 4, so that a portion of the bottom disc 14 is always located substantially right above the opening 8. Preferably, the centre of rotation of the carrier unit is arranged adjacent the opening 8. Further, the carrying member 12, in the first position, is adapted to be positioned so that the openings 15 are aligned with the package opening 8 in the housing 4, so that the package can enter and exit the device 1. This means that during a rotation of the carrier unit 10, the openings 15 in the bottom disc 14 will each come into alignment with the package opening 8 in the housing 4 so that either a package 6 loaded on the carrier unit 10 can be lowered down to the conveyor 9 or a package 6 can be raised from the conveyor 9 and loaded directly onto the carrier unit 10, see FIG. 3.

The inner chamber 2 comprises a first and a second chamber portion 2*a*, 2*b*. The first chamber portion 2*a* is provided with the emitter 5 and the second portion 2*b* is in contact with the carrier unit 10. This means that the first portion 2*a* is located above the second portion 2*b* in the figure, i.e. farthest from the conveyor 9. The carrying member 12, when positioned in the second position, is located in said second chamber portion 2*b* so that the openings 15 in the carrying member 12 are aligned with the emitter 5, so that the package 6 can be displaced to the position in which the emitter 5 is located at least partly in the package 6 for treating it. With other words, with respect to the inner chamber 2, the carrier unit 10 is arranged so in relation to the housing 4 that during a rotation of the carrier unit 10, the openings 15 in the top disc 13 will each come into alignment with the emitter 5. Through the top disc 13 opening 15 a package 6 can thereby either be removed from the carrier unit 10 and brought into the inner chamber 2 or returned to the carrier unit 10 from the inner chamber 2.

The device 1 further comprises means for providing a relative motion between the package 6 and the sterilizing unit 5 for bringing them to a position in which the sterilizing unit 5 is located at least partly in the package 6 for treating it. In the embodiment described the package is displaced towards the sterilizing unit, and thus, to displace the package 6 in the inner chamber 2 there is provided first displacing means 17. The first displacing means 17 is adapted to raise the package 6 from the carrying member 12 to a position in which the package 6 at least partly surrounds the emitter 5 and adapted to lower the package 6 back to the carrying member 12. In the embodiment shown the package 6 has to be vertically raised to and lowered from the emitter 5 and the displacing means 17 is therefore a lifting member 17. The lifting member 17 is of a conventional type comprising a bar provided with package holding means 18 in a first end thereof. The function of the package holding means 18 is to hold the package 6 during displacement and sterilization. Preferably, the package holding means 18 comprises at least one suction cup 18 that is connected to an air suction device (not shown).

The bar is adapted to be displaced between a lowered and a raised position where the package 6 in the lowered position is placed on the carrier unit 10 and where the package 6 in the raised position surrounds the emitter 5 in such a way that the free end of the emitter 5 is provided close to the bottom of the package 6. During the displacement the suction cup 18 is sucked to a lower portion of the outside of the package 6.

The vertical displacement of the bar between the raised and lowered position is obtained by connecting the bar to a drive unit, such as a linear motor (not shown). Depending on the number of packages 6 to be displaced at the same time the device may comprise more than one lifting member 17 and advantageously the members 17 can be driven by the same linear motor.

As the bar needs to be relatively long to perform the displacement, the drive unit is located outside the housing 4 in this embodiment. Thus, the bar extends out through the housing 14 in a narrow passage in the bottom of the housing 4, i.e in a direction towards the package conveyor 9. To seal off the passage it is provided with a sealing bearing.

When holding a package 6 the suction cup 18 of the first displacing means 17 extend into the inner chamber 2. To avoid breaking the suction cup 18 with the centre plate 11 during rotation of the carrier unit 10, the suction cup 18 is provided on an arm 19 rotatably fastened to the displacing means 17. Thus, the suction cup 18 is temporarily rotated away from the carrier unit 10 during rotation of the carrier unit 10.

The device 1 of the present invention is further provided with second displacing means 20 adapted to raise the package 6 through the package opening 8 and into the carrying member 12 and adapted to lower the package 6 out of the carrying member 12 and out of the package opening 8 in the housing 4. Thus, the second displacing means 20 is arranged to displace the package 6 from the conveyor 9 to the carrier unit 10. In the embodiment shown the second displacing means 20 can have a design similar to the first displacing means 17, i.e. it can comprise a conventional lifting member in the form of a bar provided with a holding member 18 in the form of at least one suction cup. Instead of holding the package 6 on a side surface, this suction cup 18 is positioned so that it can be sucked to the bottom of the package 6. The displacing means 20 is arranged underneath the conveyor 9 and is adapted to be displaced between a lowered and a raised position where the package 6 in the lowered position is placed on the conveyor 9 and where the package 6 in the raised position is positioned onto the carrier unit 10. The vertical displacement of the bar between the raised and lowered position is obtained by connecting the bar to a linear motor (not shown).

Within the packaging machine the packages 6 are conveyed and treated intermittently and a machine cycle comprises a package indexing time and a time when the conveyor 9 is stationary and the package 6 can be removed therefrom for treatment.

In the following the machine cycle will be described for a case where there is only one emitter 5, one carrying member 12 in the carrier unit 10 etc. present. The conveyor 9 indexes one package 6 to a position below the package opening 8 of the housing 4. In short, the device 1 then is adapted to raise the package 6 through the package opening 8 in the housing 4 and into the carrying member 12. The carrying member 12 is in the first position. Then the carrying member 12 is rotated to the second position. After the rotation, the package 6 is raised to a position in which it at least partly surrounds the emitter 5. The package 6 is sterilized, then it is lowered back to the carrying member 12. The carrier unit 10 rotates the carrying member 12 back to the first position. Finally, the package 6 is lowered out of the carrying member 12, out of the package opening 8 in the housing 4 and returned to the conveyor 9. By indexing the conveyor 9 again, the next unsterilized package 6 in the row of packages 6 is positioned below the package opening 8 in the housing 4.

In FIG. 3 (left side) is shown a case where there is one emitter 5, but two carrying members 12*a*, 12*b*, one at each side of the separating member 11. The conveyor 9 indexes a first package 6 to a position below the package opening 8 of the housing 4. The device 1 is then adapted to raise a first package through the package opening 8 in the housing 8 and into the first carrying member 12*a*. The first carrying member 12*a* is in the first position. At the same time the device 1 is adapted to lower a sterilized second package 6 from a position in which it at least partly surrounds the sterilizing unit 5, the emitter, down to the second carrying member 12*b*. The second carrying member 12*b* is in the second position. Next, the carrier unit 10 is rotated so that the first carrying member 12*a* with the first package 6 is rotated from the first position to the second position at the same time as the second carrying member 12*b* with the second package 6 is rotated from the second position to the first position, see FIG. 4. The carrier unit 10 is rotated 180° in clockwise direction and the holding means 16 in the carrier unit 10 holds the packages 6 during the rotation. Then, the sterilized second package 6 is lowered from the second carrying member 12*b* out through the package opening 8 in the housing 4, i.e. it is returned to the conveyor 9. At the same time the first package 6 is raised from the first carrying member 12*a*, which is now located inside the inner chamber 2, to a position in which the first package 6 at least partly surrounds the sterilizing unit 5. The first package 6 is sterilized by the emitter 5. As the emitter 5 emits electrons all time during operation of the device 1, sterilizing of the inside of the package 6 starts as soon as a portion of the package 6 starts to surround the emitter 5. When the emitter 5 is totally surrounded, the emitter 5 sterilizes the bottom of the package 6. During the sterilization the conveyor 9 is indexed so that a third package 6 is positioned below the package opening 8 of the housing 4. The third package 6 is the next unsterilized package 6 upstream the conveyor 9. In the device 1 in FIGS. 3 and 4 two packages 6 are sterilized at the same time, and therefore the conveyor 9 needs to index two packages 6, i.e make a double-indexing, so that the next unsterilized package 6 upstream is positioned underneath the opening 8 being located farthest downstream (to the right in the figures). When the conveyor 9 is stationary again the first package 6 is lowered back to the carrier unit 10 and the third package is at the same time raised into the carrier unit 10. While returning the first package 6 back to the outer chamber 3, the third package 6 can be rotated into the inner chamber 2. The rotation of the carrier unit 10 is made another 180° clockwise.

The total sterilization time is relatively long in relation to the entire cycle time as it lasts at least throughout a package indexing step. By providing a fast raising/lowering and rotation of the packages, the sterilization can last even through parts of the stationary portion of the machine cycle.

In the following the emitter 5 and electron beam sterilization will be briefly described. The emitter 5 transmits an electron beam out through an exit window 21. The emitter body 5 has the form of a cylinder with a substantially circular cross section and the exit window 21 is being located in a first end of the cylinder. In the second end of the emitter 5 there is provided means 7 for fastening the emitter 5 to the housing 4. Thus, the emitter 5 will be suspended from the top inner wall of the inner chamber 2 of the housing 4 with the exit window 21 facing downwards in a direction towards a portion of the carrying member 12 of the carrier unit 10.

The emitter body 5 generally comprises a vacuum chamber in which a filament and a cage is provided. The filament can be made of tungsten. When an electrical current is fed through the filament, the electrical resistance of the filament causes the filament to be heated to a temperature in the order of 2000° C. This heating causes the filament to emit a cloud of electrons. A cage provided with a number of openings surrounds the filament. The cage serves as a Faraday cage and help to distribute the electrons in a controlled manner. The electrons are accelerated by a voltage between the cage and the exit window 21. The emitters used are generally denoted low voltage electron beam emitters, which emitters normally have a voltage below 300 kV. In the disclosed design the accelerating voltage is in the order of 70-85 kV. This voltage results in a kinetic (motive) energy of 70-85 keV in respect of each electron. The electron exit window 21 is substantially planar. Further, the exit window is made of a metallic foil and has a thickness in the order of 6 μm. A supporting net formed of aluminium supports the exit window 21. An emitter of this kind is described in more detail in U.S. Pat. No. 6,407,492. In U.S. Pat. No. 5,637,953 is another emitter disclosed. This emitter generally comprises a vacuum chamber with an exit window, wherein a filament and two focusing plates are provided within the vacuum chamber. In U.S. Pat. No. 5,962,995 is yet another emitter disclosed, wherein the vacuum chamber being formed within an elongated member and wherein the housing surrounding the electron generator is provided with openings formed on opposite sides of the electron generator as well as between the electron generator and the window. Reference is made to the above patents for a more detailed description of these different emitters. It is contemplated that these emitters and other emitters can be used in the described system.

As long as the electrons are within the vacuum chamber, they travel along lines defined by the voltage supplied to the cage and the window 21, but as soon as they exit the emitter through the emitter window 21 they start to move in more or less irregular paths (scatter). The electrons are slowed down as they collide with amongst others air molecules, bacteria, the package 6 and the walls of the housing 4. This decrease of the speed of the electrons, i.e. a loss in kinetic energy, gives rise to the emission of X-rays (roentgen rays) in all directions.

The X-rays propagate along straight lines. When such an X-ray hits the inner wall of the housing 4 (or other part), the X-ray enters a certain distance into the material and causes emittance of new X-rays in all directions from the point of entrance of the first X-ray. Every time an X-ray hits the wall of the housing and gives rise to a secondary X-ray, the energy is about 700-1000 times less, dependent upon the choice of material for the housing 4. Stainless steel has a reduction ratio of about 800, i.e. the energy of a secondary X-ray is reduced about 800 times in relation to the primary X-ray. Lead is a material often being considered when radiation is involved. Lead has a lower reduction ratio, but has on the other hand a higher resistance against transmission of the X-rays through the material. If the electrons are accelerated by a voltage of about 80 kV, they are each given a kinetic energy of about 80 keV. In order to secure that the X-rays of this energy level do not pass through the housing 4, the housing 4, as well as the separating member 11 and the top disc 13, is made of stainless steal having a thickness of 22 mm. This thickness is calculated for X-rays travelling perpendicular to the wall. An X-ray travelling inclined in relation to the wall will experience a longer distance in the wall to reach the same depth, i.e. the wall will appear thicker. The wall thickness is determined by the governmental regulations concerning amount of radiation outside the housing 4. Today the limiting value that the radiation must be less than is 0.1 μSv/h measured at a distance of 0.1 m form any accessible surface, i.e outside the shielding. It should be noted that the choice of material and the dimensions are influenced by the regulations presently applicable and that new regulations might alter the choice of material or the dimensions. The energy of each electron (80 keV) and the number of electrons determine the total energy of the electron cloud. This total energy results in a total energy transfer to the surface to be sterilized. This radiation energy is measured in the unit Gray (Gy). Among other factors, the level of sterilization is dependent on the time the package is exposed to the cloud of electrons and the magnitude of the radiation energy.

As mentioned before the electron beam emitter 5 is a low voltage electron beam emitter. Using a low voltage electron beam emitter minimises the risk of irradiation induced changes, such as for example product off-flavour, that can be derived from the irradiated package. Further, it goes without saying that a low voltage electron beam emitter gives rise to less energy consumption and less need for strong shielding, since the electrons and the X-rays have less energy. Further, the handling of X-rays and ozone ($O_3$) formed is simplified due to the relatively small amounts created in a low voltage electron beam emitter. Moreover, when using low voltage the emitter itself can be made relatively small.

Although the electron beam emitter 5 is not in use all the time during operation of the sterilization system, i.e. there are periods in the machine cycle where there is not any package 6 present at the emitter 5, the emitter 5 is still kept in operation all time, i.e. it continuously emits electrons.

The current fed through the filament is dependent upon the radiation level decided and the area of the surface to be sterilised.

In the following the shielding of the sterilizing device 1 will be described referring to FIGS. 1*a-b* and 2*a-b*. To obtain presently applicable limiting values of the radiation outside the housing 4 it is considered that the X-rays must hit a wall twice before escaping to the surrounding environment. At least one of these hits must be in a wall of considerable thickness, which in this case is presently considered to be 22 mm of stainless steel.

There are two positions of the separating member 11 to consider. The first is denoted position A and the other position B.

Figure 1B:
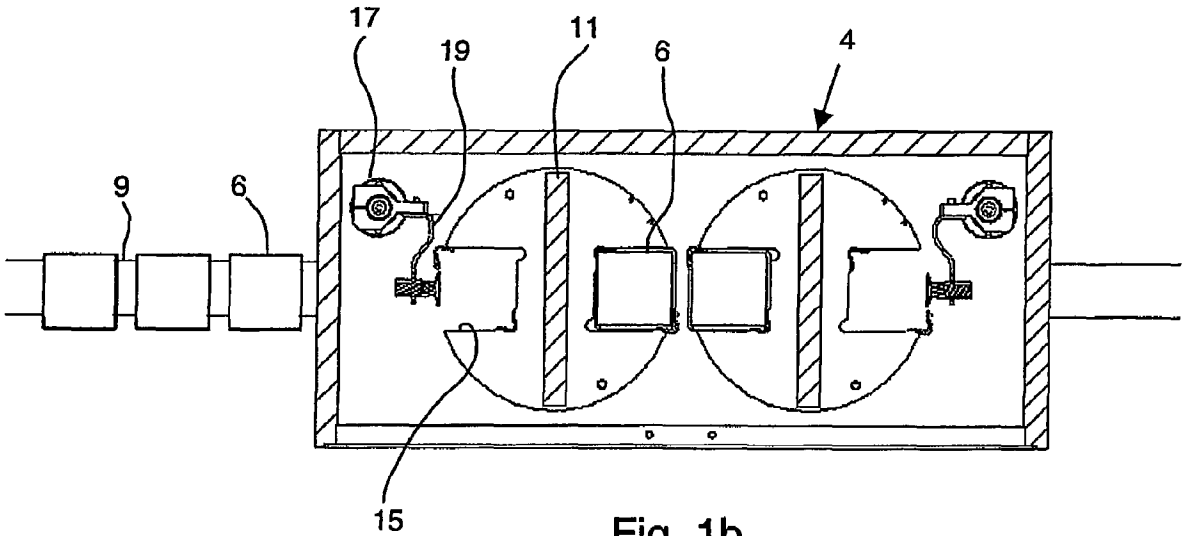

Position A, shown in FIG. 1*a-b*, covers the earlier described first and second positions of the carrier unit 10, i.e. the carrier unit 10 is positioned so that the separating member 11 thereof separates the inner and outer chambers 2, 3 from each other. In FIG. 1*a* it is shown that the separating member 11 is positioned in a plane substantially perpendicular to the paper plane and acts as a wall between the inner and outer chambers 2, 3 preventing substantially all X-rays from finding their way out to the outer chamber 3 without being forced to hit either at least the wall of the inner chamber 2 or the separating member 11, i.e. the centre plate, before leaving the inner chamber 2.

It is possible to reduce the weight of the separating member 11 by cutting portions 22 from the top side ends being positioned next to the top disc, see FIG. 5. This can be understood by studying the angle with which the X-rays need to pass through the cut-outs 22. It is realized that the angle must be about 90° in relation to an imagined longitudinal centre line of the emitter 5, i.e. the direction of the X-rays must be almost horizontal in FIG. 1*a*. With such a direction of the X-rays they cannot pass through the package openings 8 without having to hit any of the walls of the outer chamber 3 or an opposing second carrier unit 10.

Figure 8:
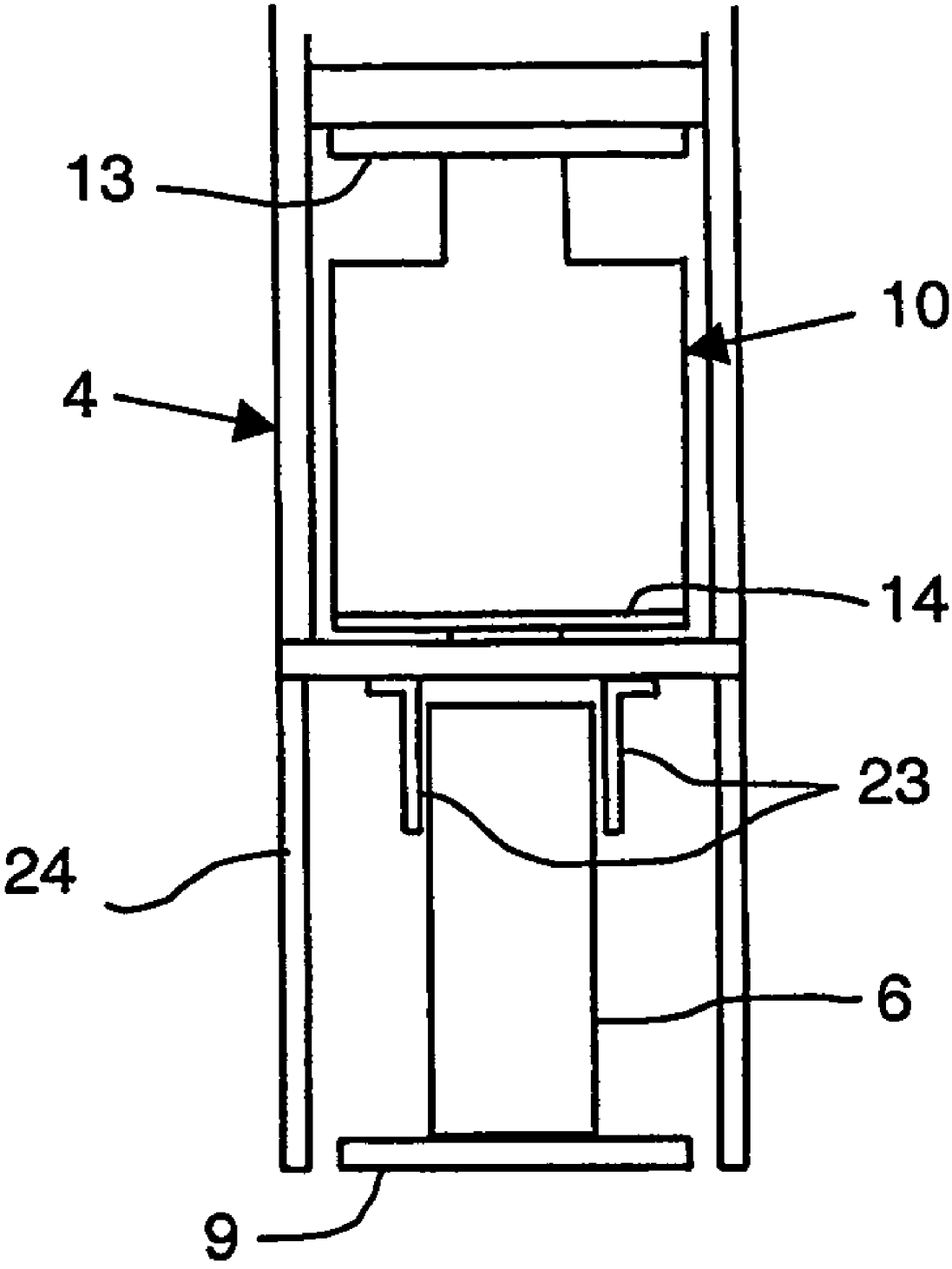

There is a small possibility that an X-ray hits the wall of the inner chamber 2 and manages to escape out of the package opening 8. However, this possibility is eliminated by two shielding plates 23, shown in FIG. 8. The plates 23 are fastened underneath the housing 4 (formed by the inner and outer chambers 2, 3) within an outer housing 24 (that will be explained later) and arranged with their longitudinal axes aligned with the direction of travel of the conveyor 9. These plates 23 force the X-ray to hit a second time before escaping to the environment surrounding the sterilizing device 1.

Further, it will be understood that since the carrier unit 10 should be able to rotate, there must be a narrow gap between the outer periphery and the housing walls. Thus, there is a slight risk that X-rays can escape through the gap after having hit the wall of the inner chamber 2. However, if those X-rays do not hit the walls of the outer chamber 3, they will hit any of the two shielding plates 23.

Further, to make sure that any X-ray does not escape through the narrow space underneath the bottom disc 14, the bottom disc 14 is provided with a shielding member 25 located between the two openings 15. The shielding member 25 can for example have the form of a double-wing as shown in FIG. 5.

In the other position B, shown in FIG. 2*a-b*, the separating member 11 is angled 90° in relation to the position A, i.e. it is positioned in a plane parallel with the paper plane. In this position the separating member 11 is not separating the inner and outer chambers 2, 3, instead the top and bottom discs 13, 14 take over the shielding. In FIG. 2*a* it is shown that the outer periphery of the top disc 13 extends a small distance past the corresponding outer periphery of the emitter 5 when referring to axis A. In this way the electrons and any X-rays are prevented from being directed directly through the passages between the inner and outer chambers 2, 3, i.e. the passages on each side of the separating member 11. Electrons and X-rays directed straight downwards from the emitter 5 or angled in any direction towards the axis A will first hit the top disc 13 or a housing covering the fastening means of the carrier unit 10 and then the wall of the inner chamber 2 before leaving the inner chamber 2, i.e. a sufficient reduction of the energy is obtained. Electrons and X-rays being angled in any direction away from the axis A will first hit the wall of the inner chamber 2 and then for example hit the bottom disc 14. In this position the bottom disc 14 effectively shields the package opening 8 in the outer chamber 3.

During sterilization ozone is formed in the inner chamber 2 and in order to be able to control, ventilate and discharge it, there is provided a flow of a gaseous fluid through the device 1. In the following, two preferred embodiments of the gaseous fluid system will be described. In both embodiments the fluid is sterile air, but it is contemplated to use any gaseous fluid suitable for the field of application in which the device 1 is used.

The function of the air system is to create a flow of a gaseous fluid through the sterilization device.

Figure 6:
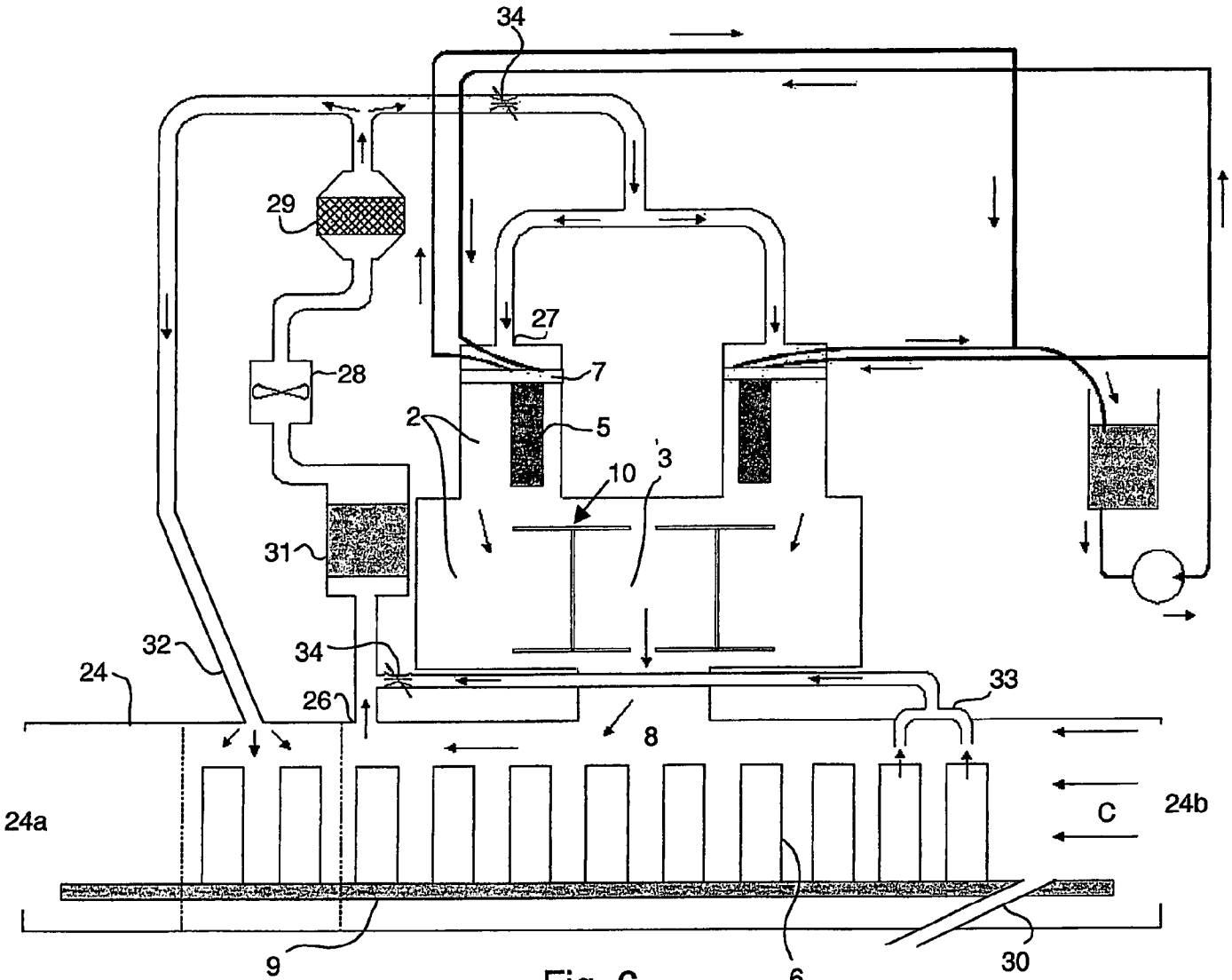

In the first embodiment, shown in FIG. 6, this flow of gaseous fluid is created from the inner chamber 2, through the carrier unit 10, through the outer chamber 3, through the package opening 8 in the housing 4 to an outer housing 24, and through at least a portion of said outer housing 24 in a direction towards a gaseous fluid outlet 26.

The outer housing 24 is used to control the flow of air and comprises a U-formed member in connection with the housing 4. The U-form is adapted to form a tunnel extending along a portion of the conveyor 9. The middle portion of the U is fastened to the bottom of the housing 4 and the leg portions of the U are directed towards the conveyor 9 so that one leg is arranged on each side of the conveyor 9. Thus, the package conveyor 9 will act as a bottom of the tunnel and the middle portion of the U-form will act as a roof. The U-formed member 24 is made of thin sheet metal. To the left in the figure there is a package infeed 24*a* in the outer housing 24 and to the right in the figure there is a package outfeed 24*b* to the filling and sealing section of the machine.

The air system according to this first embodiment comprises a supply 27 of sterile air located in the upper portion of the inner chamber 2 near the emitter fastening means 7. The air is pumped into the chamber 2 by a fan 28, for instance a blower fan, or a pump, and is made to flow along the emitter 5 down to the carrier unit 10, through the carrier unit 10, into the outer chamber 3 and further down through the openings 8 in the bottom of the housing 4. A gaseous fluid outlet 26, for discharging gaseous fluid such as air, is arranged in the outer housing 24 in a location displaced from the housing opening 8 in a direction opposite the direction of travel of the conveyor 9. The sterilization of the air is made by an air filter unit 29 which is located in between the fan 28 and the air supply 27 of the chamber 2. The air filter unit 29 can for example comprise a so-called H.E.P.A filter (which is known in the art and will therefore not be further described).

Further, the air flow through the outer housing 24 is increased by air, flowing in the direction opposite the direction of travel of the conveyor 9, from the filling section of the machine. The air flow is represented by arrows C. Thus, the filling section more or less act as an air supply for the sterilizing section of the machine. However, the air that would travel closest to the conveyor 9, i.e. in the lower portion of the outer housing 24, is vented away by a discharge pipe 30 located in the area close to the package outlet opening of the outer housing 24.

The air outlet 26 is connected to an ozone filter unit 31, comprising for instance an ozone catalyst, heater or scrubber, which in turn is connected to the fan 28 and the air filter unit 29. The outlet air is thereby cleaned from ozone and sterilized and then returned back into the air system.

The air system further comprises a circuit having the function of preventing un-sterile air to enter the outer housing 24 at the package inlet opening and at the same time also prevent air from the inner chamber 2 or the filling section to escape out through the outer housing 24 at the same location. Therefore, there is provided two branches downstream from the air filter unit 29, a first branch conducting air to the chamber 2 and a second branch being in connection with an inlet 32 into the outer housing 24. The inlet 32 is located within the outer housing 24 at a distance from the air outlet 26 in a direction opposite the direction of travel of the packages 6. Further, the inlet pipe 32 is directed slightly inclined so that the air flowing into the outer housing 24 from the inlet 32 is not directed directly downwards, but slightly forward in the direction of travel of the packages 6 thereby creating an air barrier efficiently blocking un-sterile air from outside to enter and guiding the air inside the outer housing 24 in a direction towards the air outlet 26.

The air system further comprises at least one suction pipe 33 located in the upper portion of the outer housing 24, the pipe 33 being directed down towards the openings of the packages 6 to be able to ventilate the air in the packages 6 before they exit the outer housing 24. The suction pipe 33 is connected to the ozone filter unit 31 so that the air that is ventilated out from the packages 6 is filtered and returned to the system.

The air flow through the system can be controlled and regulated by restrictor valves 34 and preferably one restrictor valve is provided in the branch between the air filter unit 29 and the supply 27 to the inner chamber 2 and another valve is provided between the suction pipe 33 and the ozone filter unit 31.

Figure 7:
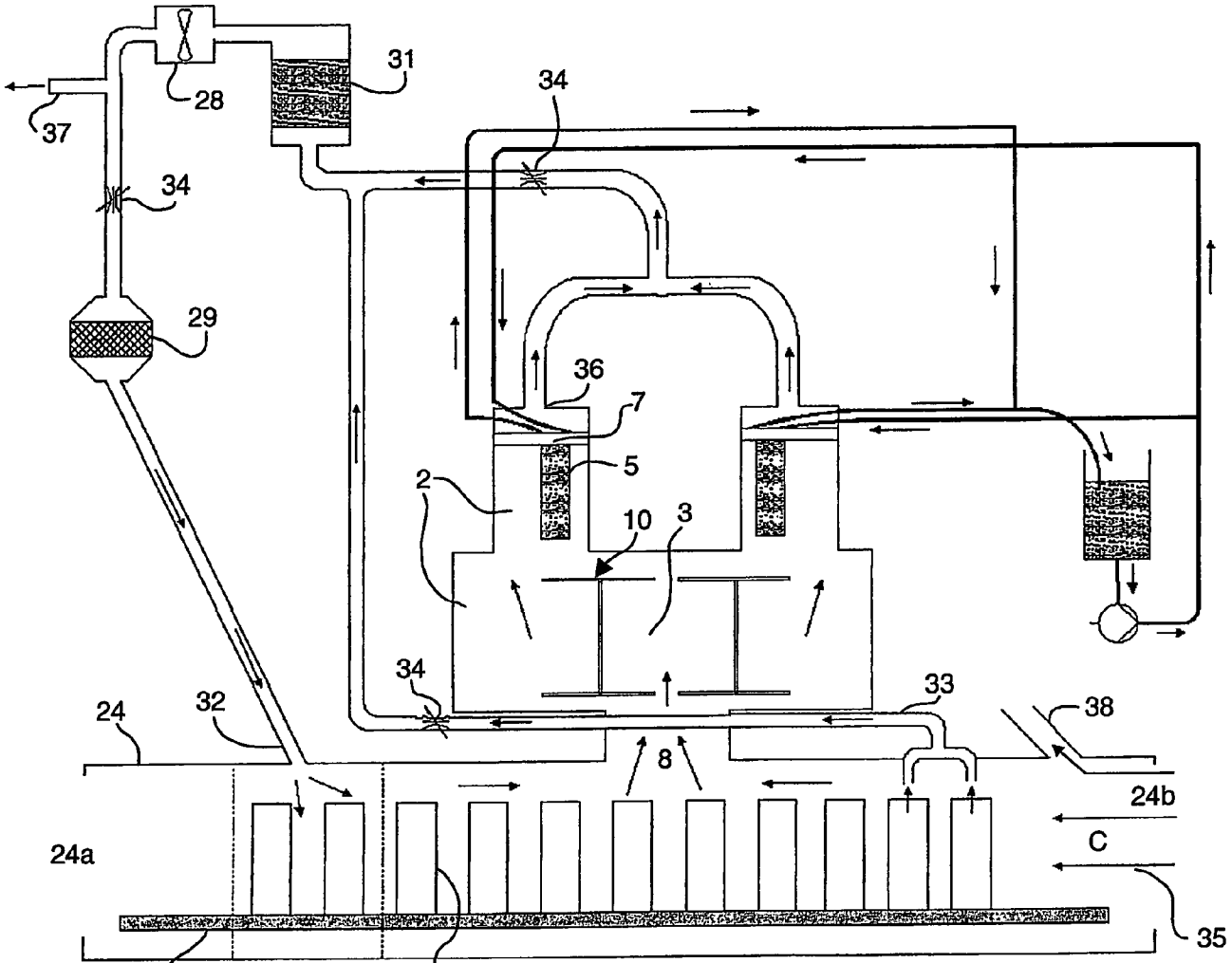

In the following, the second embodiment will be described in relation to FIG. 7. In the second embodiment the flow of gaseous fluid is instead created from the outer housing 24 in a direction towards the package opening 8 in the housing 4, through the opening 8 and into the outer chamber 3, through the carrier unit 10, and through the inner chamber 2 to a gaseous fluid outlet provided in the inner chamber 2. Thus, the flow is more or less reversed in relation to the first embodiment. However, the design of the air system is quite similar and thereby some of the reference numerals will be the same for the two embodiments. Only the differences between the two systems will be explained.

The opening in the outer housing 24 which is facing the filling section of the machine acts as a first supply 35 for sterile air. Sterile air from the filling section flows in the direction opposite the direction of travel of the conveyor 9 and the air flow is represented by arrows C. The amount of air coming from the filling section is big, thus some of the air is directly discharged from the outer housing 24 through a discharge 38. A second air supply is formed by the above mentioned inlet 32 into the outer housing 24. The inlet 32 is located within the outer housing 24 at a distance from the package opening 8 in a direction opposite the direction of travel of the packages 6 and the inlet pipe 32 is directed slightly inclined so that the air flowing into the outer housing 24 from the inlet 32 is not directed directly downwards, but slightly forward in the direction of travel of the packages 6 thereby creating an air barrier efficiently blocking un-sterile air from outside to enter and guiding the air inside the outer housing 24 in a direction towards the package opening 8.

To the left in the figure there is a package infeed 24*a* in the outer housing 24 and to the right in the figure there is a package outfeed 24*b* to the filling and sealing section of the machine.

The inner chamber 2 comprises an outlet 36 for sterile air located in the upper portion of the inner chamber 2 near the emitter fastening means 7. The air is sucked from the chamber 2 by a fan 28, for instance a blower fan, or a pump. Before reaching the fan 28 the air is filtered in an ozone filter unit 31 comprising for instance an ozone catalyst, heater or a scrubber. The outlet air is thereby cleaned from ozone. Some of the air is then returned back into the outer housing 24 via the inlet 32 and some is discharged through an outlet 37.

The sterilization of the air is made by an air filter unit 29 which is located in between the fan 28 and the inlet 32 located in the outer housing 24. The air filter unit 29 can for example comprise a so-called H.E.P.A filter (which is known in the art and will therefore riot be further described).

With this configuration air is supplied to the outer housing 24 by the first and second supplies 32, 35, the two supplies being located one on each side of the package opening 8. A flow from each supply 32, 35 is substantially directed through the outer housing 24 towards the package opening 8. By means of the fan 28 an air flow is created through the package opening 8 and into the outer chamber 3, through the carrier unit 10, and through the inner chamber 2 to the outlet 36 provided in the inner chamber 2.

The air flow through the system can be controlled and regulated by restrictor valves 34 and preferably one restrictor valve is provided between the ozone filter unit 31 and the outlet 36 and one between the outlet 37 and the filter unit 29.

The air system according to the second embodiment further comprises at least one suction pipe 33 located in the upper portion of the outer housing 24, the pipe 33 being directed down towards the openings of the packages 6 to be able to ventilate the air in the packages 6 before they exit the outer housing 24. The suction pipe 33 is connected to the ozone filter unit 31 so that the air that is ventilated out from the packages 6 is filtered and returned to the system.

The device 1 also comprises a cooling water circuit for cooling the emitters, but this circuit will not be described.

Moreover, the invention refers to a method for sterilizing at least partly formed packages 6 in a packaging machine. In the method an inner chamber 2 and an outer chamber 3 are provided and a sterilizing unit 5 is arranged in the inner chamber 2 for sterilizing at least the inside of at least one package 6. Further, a carrier unit 10 is provided comprising at least one separating member 11 and at least one package carrying member 12. Rotation is provided to the carrier unit 10 between a first position in which said at least one package carrying member 12 is located in the outer chamber 3 and in which said at least one separating member 11 separates the inner chamber 2 from the outer chamber 3, and a second position in which said at least one package 6 is located in the inner chamber 2 and in which the separating member 11 separates the inner chamber 2 from the outer chamber 3. Finally the method comprises the step of providing a relative movement between the package 6 and the sterilizing unit 5 for bringing them to a position in which the sterilizing unit 5 is located at least partly in the package 6 for treating it. In an embodiment the method can be described as follows: the package 6 is raised through the package opening 8 in the housing 4 and into the carrying member 12 when the carrying member 12 is in the first position. The carrying member 12 is rotated to the second position and the package 6 is raised to a position in which it at least partly surrounds the sterilizing unit 5. The package 6 is sterilized with the sterilizing unit 5 and then lowered back to the carrying member 12. The carrying member 12 is rotated back to the first position, and the package 6 is lowered out of the carrying member 12 and out of the package opening 8 in the housing 4.

Similarly, a method for handling at least two packages 6 in the carrier unit 10 comprises the steps of: raising at least a first package 6 through the package opening 8 in the housing 4 and into the first carrying member 12*a*, the first carrying member 12*a* being in the first position, and at the same time lowering at least a sterilized second package 6 from a position in which it at least partly surrounds the sterilizing unit 5 down to the second carrying member 12*b*, the second carrying member 12*b* being in the second position, rotating the carrier unit 10 so that the first carrying member 12*a* with said at least first package 6 is rotated from the first position to the second position at the same time as rotating the second carrying member 12*b* with said at least second package 6 from the second position to the first position, lowering the sterilized second package 6 from the second carrying member 12*b* out through the package opening 8 in the housing 4, and at the same time raising the first package 6 from the first carrying member 12*a*, being located inside the inner chamber 2, to a position in which the first package 6 at least partly surrounds the sterilizing unit 5, and sterilizing the first package 6. The sterilizing unit 5 used in the method is an electron beam emitter.

Although the present invention has been described with respect to a presently preferred embodiment, it is to be understood that various modifications and changes may be made without departing from the object and scope of the invention as defined in the appended claims.

The invention has for example been described in relation to sterilizing of RTF packages and in the text the term "package" has been used referring to a ready-to fill package (RTF package). However, as the sterilizing device 1 is not for use solely in relation to RTF packages, it should be understood that the term "package" also refers to other types of partly formed packages such as for example tube-formed blanks, i.e packages where neither the bottom nor the top are formed. In the case of a tube-formed blank, the second displacing means 20 must be modified so as to hold the package 6 on at least one side instead of holding it on the bottom. Moreover, it should be understood that the term "package" also covers other packages that are ready to fill, for example plastic bottles and the like.

In the embodiment described the emitter 5 is static and the package 6 is lifted towards the emitter 5. However, it should be understood that it is of course possible to instead move the emitter 5 towards the package 6. Thus, in the embodiment described the emitter 5 could for instance be lowered down into the package 6 while the package 6 is still located at the carrier unit 10. Alternatively, both the package 6 and the emitter 5 are each moved a distance towards each other.

As have been mentioned above the sterilization unit 5 need not be a low voltage electron beam emitter. Instead the sterilization unit 5 can for example be a unit for chemical sterilization using for instance hydrogen peroxide or a unit comprising a UV-lamp for sterilization using ultraviolet radiation. If sterilization is made using hydrogen peroxide or ultraviolet radiation the device may be changed. For instance, the material thickness of the housing walls and the crucial portions of the carrier unit 10 can be reduced. Further, if using hydrogen peroxide sterilization, the size and shape of the separating member 11 is not as crucial as when using an electron beam emitter. However, the flow of air will be more crucial and preferably, extra outlets for discharging ozone and hydrogen peroxide from the chamber may be provided. On the other hand, when using ultraviolet radiation it is instead important that the separating member 11 has a size and shape configured to prevent the rays of light to escape out of the chambers without having to bounce at least once somewhere inside the chambers. Further, to minimize reflectivity the walls inside the chamber can also be provided with an anti-reflex coating.

In the embodiment shown in the drawings, the device 1 is provided with two emitters 5, carrier units 10 and inner chambers 2 successively located in the conveying direction of the packaging machine making it possible to simultaneously sterilize two packages 6 being adjacent each other on the conveyor 9. The conveyor 9 is then indexed so that two successive packages 6 are moved in front of the package openings 8 in the housing 4. Alternatively, the housing 4 shown in the figures is rotated 90° around the axis A in relation to the package conveying direction. Two package conveyors 9 can then be provided side by side each indexing one package 6 at a time.

Further, the carrying member 12 of the carrier unit 10 can be modified to being able to carry more than one package 6. For example two packages 6 can be provided on each side of the separating member 11. The inner chamber 2 is then provided with two emitters 5. If such an embodiment also comprises two carrier units 10, two inner chambers 2 (thereby a total of four emitters), the conveyor 9 can index four partly formed packages 6 at a time, or the packaging machine is provided with double conveyors 9 (as described above) indexing two partly formed packages 6 at a time.

Further, the carrier unit 10 in the described embodiment carries two packages 6 at an angle of 180° from each other. Alternatively, the angle between the packages 6 is smaller, for example the angle can be about 45°. The carrier unit 10 can then carry at least eight packages 6, or sixteen packages 6 if there are two packages loaded at each 45°. The rotation of the carrier unit 10 can then be made in steps of 45° and the emitter or emitters 5 can be arranged at one or several of the steps, preferably at a position opposite the entrance of the packages from the outer chamber 3. In an embodiment of the above-mentioned type, the carrier unit 10 can be provided with more separating members 11, for example eight, and due to the larger number of rotation steps of the carrier unit 10, each package stays a longer time in the carrier unit 10. If the carrier unit is made large with many separating members the emitters do not need to be located opposite the entrance of the packages, i.e. 180° from the entrance, but can be located at an another angle, for example 90°. Similar, the entrance and exit of packages do not need to be at the same place. For example the exit of packages can be made at another angle than the entrance of packages, for example 180°.

It has been described that the carrier unit 10 is driven by a servomotor. If the servomotor cannot be positioned aligned with the axis of rotation of the carrier unit 10 or if there are more than one carrier unit 10 in the device, belt transmissions can be provided between the shafts and the servomotor. Alternatively, a servomotor can be provided to each carrier unit 10.

The rotation of the carrier unit 10 is made in the clockwise direction, but it should be understood that it could just as well be made in a counterclockwise direction. Alternatively, the first 180° of a rotation can be made in one of said directions, and the remaining 180° in the other of said directions.

In the second embodiment of the air system there is provided two sterile air supplies 32, 35. It should however be understood that the number of supplies as well as their location can be different from what has been shown.

Further, as has been mentioned above, the sterilizing unit 5 can comprise more than one electron beam emitter.

Finally, the emitter has been described having the exit window 21 located in a first end of the cylinder body. It should be understood that the exit window can be located in another position, such as for example at the envelope surface of the cylinder body. This configuration is e.g. described in U.S. Pat. No. 6,407,492.

The invention claimed is:

1. Device for sterilizing at least partly formed packages in a packaging machine, said device comprises an inner chamber and an outer chamber, the inner chamber being provided with a sterilization unit for sterilizing at least an inside of at least one partly formed package, the device further comprises a carrier unit comprising at least one separating member and at least one package carrying member, the carrier unit being adapted to rotate between a first position in which said at least one package carrying member is located in the outer chamber and adapted to return and receive at least one package, and in which said at least one separating member separates the inner chamber from the outer chamber, and a second position in which the carrier unit has rotated and displaced said at least one package into the inner chamber and in which said at least one separating member separates the inner chamber from the outer chamber, and the device further comprises means for providing a relative motion between the package and the sterilizing unit for bringing them to a position in which the sterilizing unit is located at least partly in the package for treating it.

2. The device according to claim 1, wherein the inner and outer chambers form a housing, and the carrier unit is rotatably connected to said housing.

3. The device according to claim 1, wherein the relative motion between the package and the sterilizing unit involves the package moving towards the sterilizing unit to surround it.

4. The device according to claim 1, wherein the outer chamber is provided with a package opening for entrance and exit of packages to and from the device.

5. The device according to claim 4, wherein it is adapted to raise the package through the package opening and into the carrying member when the carrying member is in the first position, rotate the carrying member to the second position, raise the package to a position in which it at least partly surrounds the sterilizing unit, sterilize the package with the sterilizing unit, lower it back to the carrying member, rotate the carrying member back to the first position, and lower the package out of the carrying member and out of the package opening.

6. The device according to claim 5, wherein it comprises first displacing means adapted to raise the package from the carrying member to a position in which the package at least partly surrounds the sterilizing unit and adapted to lower the package back to the carrying member.

7. The device according to claim 5, wherein it comprises second displacing means adapted to raise the package through the package opening and into the carrying member and adapted to lower the package out of the carrying member and out of the package opening.

8. The device according to claim 1, wherein the separating member is substantially shaped as a plate, and the carrying member comprises two substantially disc-shaped members, both being perpendicularly arranged in relation to the separating member.

9. The device according to claim 8, wherein the disc-shaped members each being non-rotatably connected to a respective end portion of the separating member.

10. The device according to claim 8, wherein the two disc-shaped members are provided with at least one through-going opening each, the openings being aligned with each other.

11. The device according to claim 10, wherein the carrying member is provided with holding means being aligned with the openings.

12. The device according to claim 10, wherein the inner and outer chambers form a housing provided with a package opening, and wherein the carrying member, in the first position, is adapted to be positioned so that the openings are aligned with the package opening in the housing, so that the package can enter and exit the device.

13. The device according to claim 1, wherein the inner chamber comprises a first and a second chamber portion.

14. The device according to claim 13, wherein the sterilizing unit is located in said first chamber portion, and wherein the carrying member, in the second position, is located in said second chamber portion so that the openings in the carrying member are adapted to be aligned with the sterilizing unit, so that the package can be displaced to the position in which the sterilizing unit is located at least partly in the package for treating it.

15. The device according to, claim 1 wherein the carrier unit comprises at least a first and a second carrying member, at least one at either side of the separating member, so that the first carrying member is adapted to rotate and displace a first package from the first position to the second position at the same time as the second carrying member is adapted to rotate and displace a second package from the second position to the first position.

16. The device according to claim 15, wherein the inner and outer chambers form a housing provided with a package opening, and wherein the device is adapted to raise a first package through the package opening in the housing and into the first carrying member, the first carrying member being in the first position, and at the same time lower a second package from a position in which it at least partly surrounds the sterilizing unit down to the second carrying member, the second carrying member being in the second position.

17. The device according to claim 15, wherein the inner and outer chambers form a housing provided with a package opening, and wherein the device is adapted to lower a first package from the first carrying member out through the package opening in the housing, the first carrying member being in the first position, and at the same time raise a second package from the second carrying member, the second carrying member being in the second position, to a position in which the second package at least partly surrounds the sterilizing unit.

18. The device according to claim 1, wherein the sterilizing unit is an electron beam emitter.

19. The device according to claim 18, wherein the sterilizing unit comprises more than one electron beam emitter.

20. The device according to claim 1, wherein the carrying member is adapted to carry more than one package.

21. The device according to claim 1, wherein the inner chamber being provided with a gaseous fluid supply, the outer chamber being in connection with an outer housing via a package opening, the outer housing at least partly surrounding a package conveyor and being provided with a gaseous fluid outlet, said outlet being located in a portion of the outer housing that is being arranged from the package opening in a direction opposite the direction of travel of the package conveyor, the supply and the gaseous fluid outlet are adapted to create a flow of a gaseous fluid from the inner chamber, through the carrier unit, through the outer chamber, through the package opening in the housing to the outer housing, and through at least a portion of the outer housing in a direction towards the gaseous fluid outlet.

22. The device according to claim 1, wherein the inner chamber is provided with a gaseous fluid outlet, the outer chamber is in connection with an outer housing via a package opening, the outer housing at least partly surrounding a package conveyor and being provided with gaseous fluid supplies, at least one of which is located in a portion of the outer housing that is being arranged from the package opening in a direction being the direction of travel of the package conveyor, and at least one of which being located in a portion of the outer housing that is being arranged from the package opening in a direction opposite the direction of travel of the package conveyor, the outlet and the gaseous fluid supplies are adapted to create a flow of a gaseous fluid towards the package opening in the housing, through the opening and into the outer chamber, through the carrier unit, and through the inner chamber to the gaseous fluid outlet.

23. Method for sterilizing at least partly formed packages in a packaging machine, the method comprising:

arranging a sterilizing unit in an inner chamber for sterilizing at least an inside of at least one package, rotating a carrier unit, comprising at least one separating member and at least one package carrying member, between a first position in which said at least one package carrying member is located in an outer chamber and in which said at least one separating member separates the inner chamber from the outer chamber, and a second position in which the package carrying member is located in the inner chamber and in which the separating member separates the inner chamber from the outer chamber, and providing a relative movement between the package and the sterilizing unit for bringing them to a position in which the sterilizing unit is located at least partly in the package for treating it.

24. Method according to claim 23, wherein it comprises:

raising the package through a package opening in a housing and into the carrying member when the carrying member is in the first position, rotating the carrying member to the second position, raising the package to a position in which it at least partly surrounds the sterilizing unit, sterilizing the package with the sterilizing unit, lowering it back to the carrying member, rotating the carrying member back to the first position, and lowering the package out of the carrying member and out of the package opening in the housing.

25. Method according to claim 23, wherein it comprises:

raising at least one first package through a package opening in a housing and into the first carrying member, the first carrying member being in the first position, and at the same time lowering a sterilized second package from a position in which it at least partly surrounds the sterilizing unit down to the second carrying member, the second carrying member being in the second position, rotating the carrier unit so that the first carrying member with the first package is rotated from the first position to the second position at the same time as rotating the second carrying member with the second package from the second position to the first position, lowering the sterilized second package from the second carrying member out through the package opening in the housing, and at the same time raising the first package from the first carrying member, being located inside the inner chamber, to a position in which the first package at least partly surrounds the sterilizing unit, and sterilizing the first package.

26. Method according to claim 23, wherein the sterilizing unit is an electron beam emitter.

27. Method according to claim 23, comprising:

providing the inner chamber with a gaseous fluid supply, providing the outer chamber in connection with an outer housing via a package opening, the outer housing at least partly surrounding a package conveyor and being provided with a gaseous fluid outlet, said outlet being located in the portion of the outer housing that is being arranged from the package opening in a direction opposite a direction of travel of the package conveyor, creating a flow of the gaseous fluid from the inner chamber, through the outer chamber, through the package opening in the housing to the outer housing, and through at least a portion of the outer housing in a direction towards the gaseous fluid outlet.

28. Method according to claim 23, comprising:

providing the inner chamber with a gaseous fluid outlet, providing the outer chamber in connection with an outer housing via a package opening, the outer housing at least partly surrounding a package conveyor and being provided with gaseous fluid supplies, at least one of which is located in a portion of the outer housing that is arranged from the package opening in a direction being a direction of travel of the package conveyor, and at least one of which is located in a portion of the outer housing that is arranged from the package opening in a direction opposite the direction of travel of the package conveyor, creating a flow of the gaseous fluid towards the package opening in the housing, through the opening and into the outer chamber, through the carrier unit, and through the inner chamber to the gaseous fluid outlet.

* * * * *